US008956192B2

(12) United States Patent
Eckel et al.

(10) Patent No.: US 8,956,192 B2
(45) Date of Patent: Feb. 17, 2015

(54) FINGER PROTECTION FOR 90° HEADER

(75) Inventors: Markus Eckel, Buerstadt (DE); Adriano Plazio, Turin (IT); Fulvio Amerio, Turin (IT)

(73) Assignees: Tyco Electronics AMP GmbH, Bensheim (DE); Tyco Electronics AMP Italia SRL, Torino (IT)

( * ) Notice: Subject to any disclaimer, the term of this patent is extended or adjusted under 35 U.S.C. 154(b) by 68 days.

(21) Appl. No.: 13/816,892

(22) PCT Filed: Aug. 9, 2011

(86) PCT No.: PCT/EP2011/063589

§ 371 (c)(1),
(2), (4) Date: Feb. 13, 2013

(87) PCT Pub. No.: WO2012/019986

PCT Pub. Date: Feb. 16, 2012

(65) Prior Publication Data

US 2013/0143448 A1 Jun. 6, 2013

(30) Foreign Application Priority Data

Aug. 13, 2010 (EP) ..... 10008462

(51) Int. Cl.
*H01R 13/641* (2006.01)
*H01R 13/44* (2006.01)
(Continued)

(52) U.S. Cl.
CPC ..... *H01R 13/44* (2013.01); *H01R 13/502* (2013.01); *H01R 13/53* (2013.01); *H01R 13/641* (2013.01); *H01R 43/20* (2013.01); *H01R 2201/26* (2013.01)
USPC ..... 439/686

(58) Field of Classification Search
USPC ..... 439/686, 689, 690, 693, 362; 29/876
See application file for complete search history.

(56) References Cited

U.S. PATENT DOCUMENTS 4,426,121 A 1/1984 Stoewe et al.
5,230,634 A 7/1993 Yamaguchi et al.
(Continued)

FOREIGN PATENT DOCUMENTS

DE 10055148 A1 5/2002
EP 0951099 A2 10/1999
(Continued)

OTHER PUBLICATIONS

International Search Report and Written Opinion Issued by the European Patent Office, dated Aug. 29, 2011, for related International Application No. PCT/EP2011/063589; 10 pages.
(Continued)

*Primary Examiner* — Alexander Gilman
(74) *Attorney, Agent, or Firm* — Faegre Baker Daniels LLP

(57) ABSTRACT

The present invention relates to an electrical plug-in connector (1) in particular for high-voltage connections, comprising an outer body (2) having a plug opening (5) for receiving a mating plug-in connector (101), a terminal housing (8, 8', 8", 13, 13', 13", 13'") for fastening an electrical contact (36), and a finger protection member (25) projecting into the plug-in direction (X) towards the plug opening (5). Further, the present invention relates to a finger protection member (25) for an electrical high-voltage plug-in connector (1), with a bar-shaped body having a protection end (56), and to a construction kit for a high-voltage electrical plug-in connector (1), comprising an outer body (2) with a plug opening (5) for receiving a mating plug-in connector (101), and at least one terminal housing (8, 8', 8", 13, 13', 13", 13'") for fastening an electrical contact (36). Finally, the present invention relates to a method for assembling a plug-in connector (1), in particular for high-voltage connections, wherein a terminal housing (8, 8', 8", 13, 13', 3", 13'") of the plug-in connector (1) is inserted into an outer body (2) of the plug-in connector (1) having a plug opening (5) which opens towards a plug-in direction (X) of the plug-in connector (1). In order to provide a plug-in connector (1) which is more plug-compatible than 1 known connectors with a finger protection device (25), yet user friendly, the present invention provides that the finger protection member (25) is a separate piece engaged with the terminal housing (8, 8', 8", 13, 13', 13", 13'").

15 Claims, 20 Drawing Sheets

Figure 1:
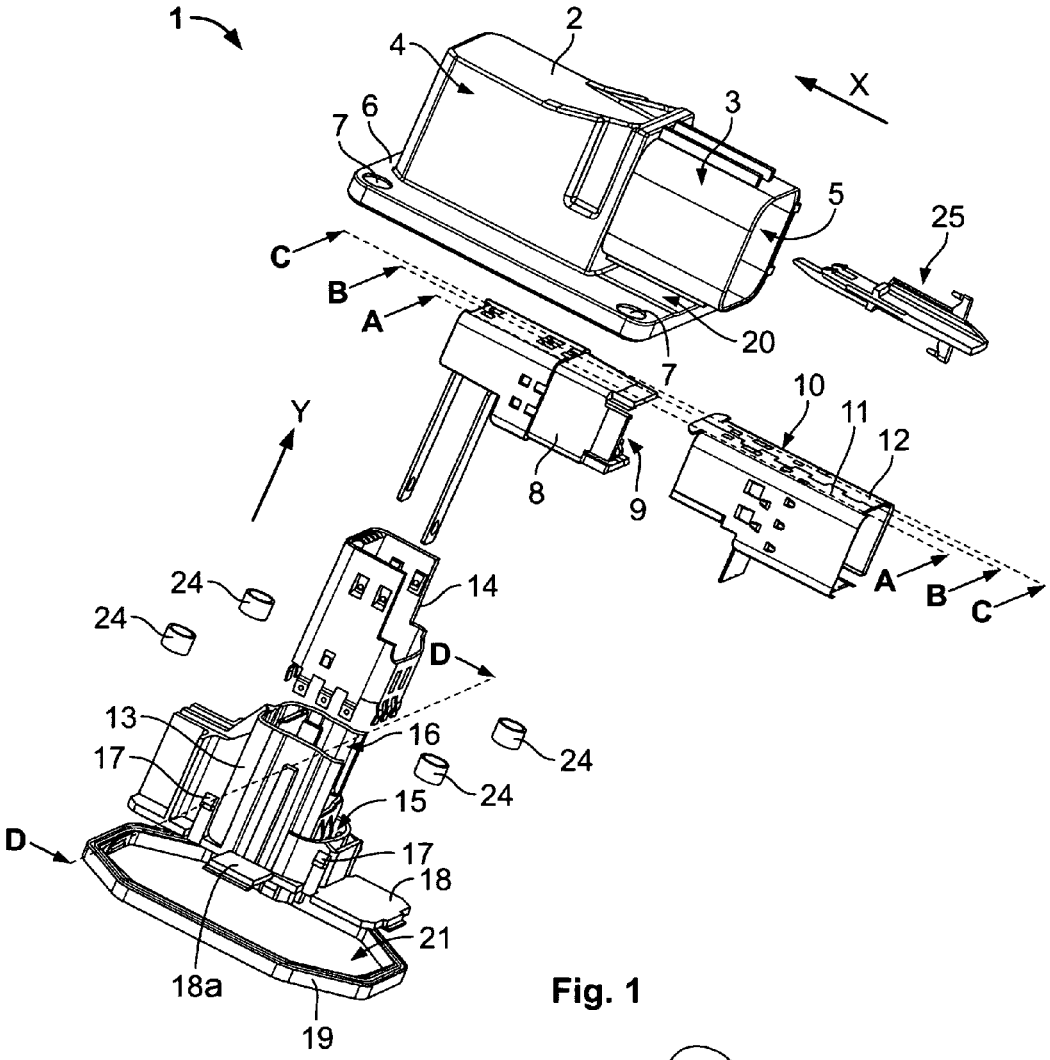

(51) Int. Cl.

| | |
|---|---|
| ***H01R 13/502*** | (2006.01) |
| ***H01R 13/53*** | (2006.01) |
| ***H01R 43/20*** | (2006.01) |

(56) References Cited

U.S. PATENT DOCUMENTS

| | | | | |
|---|---|---|---|---|
| 6,113,436 | A * | 9/2000 | Kuwahara et al. | 439/693 |
| 7,316,584 | B2 * | 1/2008 | Mackillop et al. | 439/607.05 |
| 8,579,647 | B2 * | 11/2013 | Phillips et al. | 439/345 |
| 8,591,268 | B2 * | 11/2013 | Reimchen | 439/701 |
| 2008/0124983 | A1 * | 5/2008 | Sundermeier | 439/690 |
| 2012/0034809 | A1 * | 2/2012 | Reimchen | 439/362 |

FOREIGN PATENT DOCUMENTS

| | | | |
|---|---|---|---|
| EP | 2184811 | A2 | 5/2010 |
| WO | WO 2006/100045 | A1 | 9/2006 |
| WO | WO 2010/041103 | A1 | 4/2010 |

OTHER PUBLICATIONS

European Search Report issued by the European Patent Office (The Hague), dated Dec. 22, 2010, for related Application No. EP 10008462; 6 pages.

International Preliminary Report on Patentability issued by the International Bureau of WIPO, Geneva, Switzerland, dated Feb. 19, 2013, for related International Application No. PCT/EP2011/063589; 6 pages.

* cited by examiner

FINGER PROTECTION FOR 90° HEADER

The present invention relates to an electrical plug-in connector in particular for high-voltage connections, comprising an outer body having a plug opening for receiving a mating plug-in connector, a terminal housing for fastening an electrical contact, and a finger protection member projecting into the plug-in direction.

Further, the present invention relates to a finger protection member for an electrical high-voltage plug-in connector, with a bar-shaped body having a protection end.

Moreover, the present invention relates to a construction kit for a high-voltage electrical plug-in connector, comprising an outer body with a plug opening for receiving a mating plug-in connector, and at least one terminal housing for fastening an electrical contact.

Finally, the present invention relates to a method for assembling a plug-in connector, in particular for high-voltage connections, wherein a terminal housing of the plug-in connector is inserted into an outer body of the plug-in connector having a plug opening which opens towards a plug-in direction of the plug-in connector.

Electrical plug-in connectors, finger protection members, construction kits and a method for their assembly mentioned above are known. For example, in automotive applications, especially electrically driven motor vehicles, the plug-in connectors are used for connecting high-voltage/high-current batteries to an on-board power supply. Due to the high-voltage/high-current, it is important to protect the electrical contacts against a touch which could lead to an electric shock and severe injury of an assembly operator. Further, the contacts have to be protected against damage or short circuits which could be caused by elements entering the connector through the plug opening.

Known connectors mentioned above suffer from the disadvantage that especially in 90°-applications, i.e. the plug-in direction and the mounting direction are perpendicular to each other, an overall length of the terminal housing in the plug-in direction exceeds a certain limit up to which the same socket boards and mating plug-in connectors may be used for the 90°-connectors as well as 180°-connectors, where the plug-in direction and the mounting direction run parallel.

In view of the disadvantages of the prior art mentioned above, an object underlying the invention is to provide a plug-in connector which is more plug-compatible than known connectors with a finger protection device, yet user friendly.

This object is achieved according to the invention for the plug-in connector mentioned in the beginning of the introduction in that the finger protection member is a separate piece engaged with the terminal housing.

For a finger protection member mentioned in the beginning of the description, the object is achieved according to the present invention in that an end portion of the finger protection member opposing the protection end is formed as a retention end having at least one retention element for affixing the finger protection member in the plug-in connector.

In respect to the construction kit mentioned in the beginning of the description, the object is achieved in that the construction kit further comprises a finger protection member according to the present invention.

In a method for assembling a plug-in connector mentioned in the beginning of the description, the object is achieved according to the present invention in that a finger protection member is plugged into the terminal housing through the plug opening.

These simple solutions provide that a plug-in connector according to the present invention is compatible to mating plug-in connectors which may also be used for 180°-connections. By forming the finger protection member as a separate piece, an overall length of the terminal housing may be kept within certain limits. Thus, an overall length of a mounting opening of the outer body, into which the terminal housing is to be inserted in a mounting direction may be reduced. Hence, the outer dimensions of the mounting section do not interfere with outer dimensions of a plug portion of the plug-in connector. Thereby, the plug-portion may be designed without any interference or negative impact of the mounting section in order to be compatible to standard mating plug-in connectors.

Further, the finger protection member as a separate piece allows for replacement of the finger protection member in case it is damaged without replacing the entire terminal housing. As a further advantage of the present invention arising from the separation of the finger protection member and the terminal housing, the terminal housing may be adapted to certain requirements without replacing or changing the design of the finger protection member. As an example, any receptacles within the terminal housing for electrical contacts may be designed as required by a certain application. In order to adapt the terminal housing to a certain application, only minor changes in a molder for the terminal housing are necessary for forming the terminal housing such that it may accommodate different types and/or quantities of electrical contacts. This facilitates to customize an electrical plug-in connector according to the present invention. Thus, the user-friendliness is improved.

The solutions according to the invention can be combined as desired and further improved by the following further embodiments that are advantageous on their own in each case:

According to a first possible further embodiment of a plug-in connector according to the present invention, the finger protection member is plugged into a protection member receptacle formed in the terminal housing and running in the plug-in direction. The protection member receptacle may be designed to match an outer contour of the finger protection member in order to unequivocally assigning the finger protection member into the designated receptacle. For further facilitating the orientation of the finger protection member, the protection member receptacle allows to form a finger protection member guidance. The finger protection member guidance may be formed such that it provides for a coding of the finger protection member. Thereby, an insertion orientation of the finger protection member is predefined. The finger protection member may therefore be provided with a guidance whose contour matches the finger protection member guidance formed in the terminal housing. Hence, the protection member receptacle improves mounting the finger protection member precisely and stable at the electrical plug-in connector.

According to another possible configuration of a plug-in connector according to the present invention, it may be provided that the assembly constituted by the terminal housing and the finger protection member plugged into the protection member receptacle has a length exceeding the length of a mounting opening of the plug-in connector which opens towards a mounting direction for inserting the terminal housing into the outer body. Hence, the length of the mounting opening may only be adapted to the length of the terminal housing without the finger protection member. Thereby, the present invention enables to shorten or maintain the length of the mounting opening and to leave room for a length of the plug portion required for being compatible to 180° mating plug-in connectors, while keeping the overall dimensions of the plug-in connector and especially providing a certain length of the finger protecting member required to ensure proper protection. Keeping the overall dimensions of the plug-in connector within certain limits is especially desirable in order to make the plug-in connector compatible to the dimensions of socket boards within electrical devices to which the plug-in connector is mounted via the mounting section. Further, the dimensions of sealings to be interposed between the plug-in connector and the electrical device may be standardized. The same patterns for mounting holes in the electric devices may be used for both 90° and 180°-connection applications.

The sealings are important whenever the plug-in connector is used in hostile environments, as when it is applied in vehicles. Then the plug-in connector is exposed to vibrations, moisture, dirt, dust and possible chemical aggressive substances. When abrasive, corroding or electrically conducting substances would get into a connection are between the contact elements of the connector and respective mounting contact elements of the electric device, they could cause interruptions of the power supply or short circuits. Hence, the connector has to be provided with sealings which prevent any harmful substances from entering the connector and affecting the contact elements arranged therein. It is desired to hermetically seal the connector. Overall sealing should at least be liquid-tight and optimally gas-tight.

According to another possible embodiment of a plug-in connector according to the present invention, it may be provided that the plug-in direction and the mounting direction are perpendicular to each other. In other words, the plug-in connector may be designed as a 90°-connector. This helps minimizing a headroom occupied by the connector. Hence, a height with which the plug-connector protrudes from an electrical device is limited. Thus, the user-friendliness and mountability of the plug-in connector is improved.

According to another possible embodiment of a plug-in connector according to the present invention, a blocking member is provided at the terminal housing which in a near-end-position where the terminal housing is not fully latched with the outer body constitutes a stopping element blocking the complete plugging of the finger protection member. Hence, an insertion of the finger protection member is prevented or at least interrupted before the finger protection member has reached a locked position where it is fully mated with the terminal housing. In contrast, in the end-position of the terminal housing the blocking member and the check member do not interfere. In other words, when the terminal housing is inserted into the outer body but not latched in the end-position and therefore still in a pre-end-position, the blocking member interferes with a space occupied by the finger protection member in its locked position, where the finger protection member is fully mated and locked with the terminal housing. Thereby, the finger protection member may not be inserted into the plug-in connector when the terminal housing is in a near-end-position. Otherwise, when the protection member is fully mated and locked with the terminal housing in a locked position, a further terminal housing, like a mounting section terminal housing, is to be inserted into the outer body, the finger protection member will prevent the further terminal housing from being inserted into the plug-in connector thereby indicating an improper assembly of the connector. Hence, the finger protection member may fulfill and alternate action in that it ensures a proper position of the terminal housing.

A finger protection member according to the present invention may be further improved pursuant to a possible embodiment of the present invention in that the finger protection member is provided with at least one stabilizing arm protruding from the finger protection member essentially perpendicular to the plug-in direction, the stabilizing arm adapted to laterally support the finger protection member. Therefore, the arms may be provided with stabilizing elements which may protrude from the arms in the plug-in direction in order to jut into respective receptacles formed at the terminal housing. Hence, the finger protection member may be supported sidewise in that the arms may take up any momentum having an effect on the finger protection member.

Affixing the finger protection member may be further improved in that the retention end may be provided with a further retention element, the retention element and the further retention element may counteract in opposing directions which are perpendicular to a plug-in direction. Thereby, the retention element and further retention element may act as counter retention element, providing a stable fixation of the finger protection member within the plug-in connector.

According to another embodiment of a protection member according to the present invention it may be provided that a check member is formed at the retention end and protrudes therefrom in the plug-in direction in order to interfere with a space occupied by a blocking member within the plug-in connector, when the plug-in connector is not in an end-position. As already stated in relation to an improvement of the plug-in connector by providing a blocking member at the terminal housing, the check member formed at the finger protection member enables an alternate action. The finger protection member may be used both for protecting and checking purposes in that it signalizes an improper assembly state of the plug-in connector by hitting on a blocking member or other elements within the plug-in connector having a similar functionality.

Figure 2:
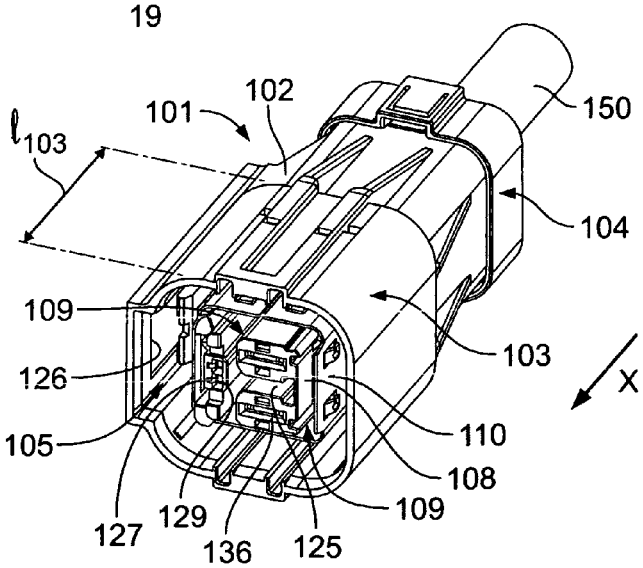
Figure 3:
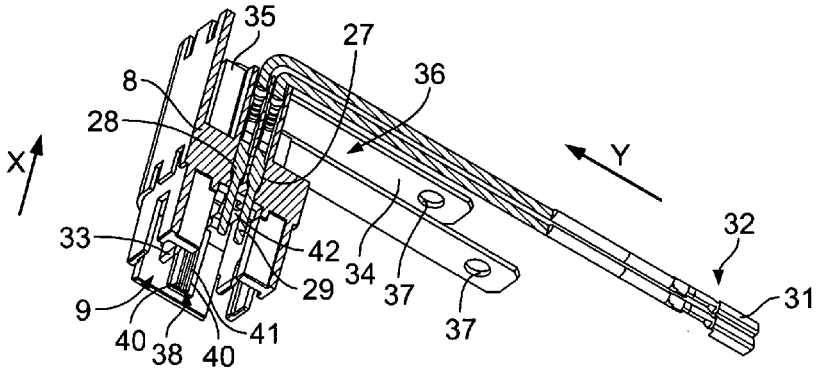
Figure 4:
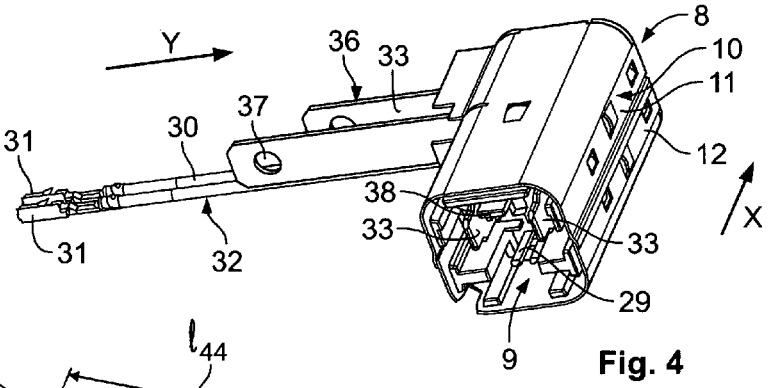
Figure 5:
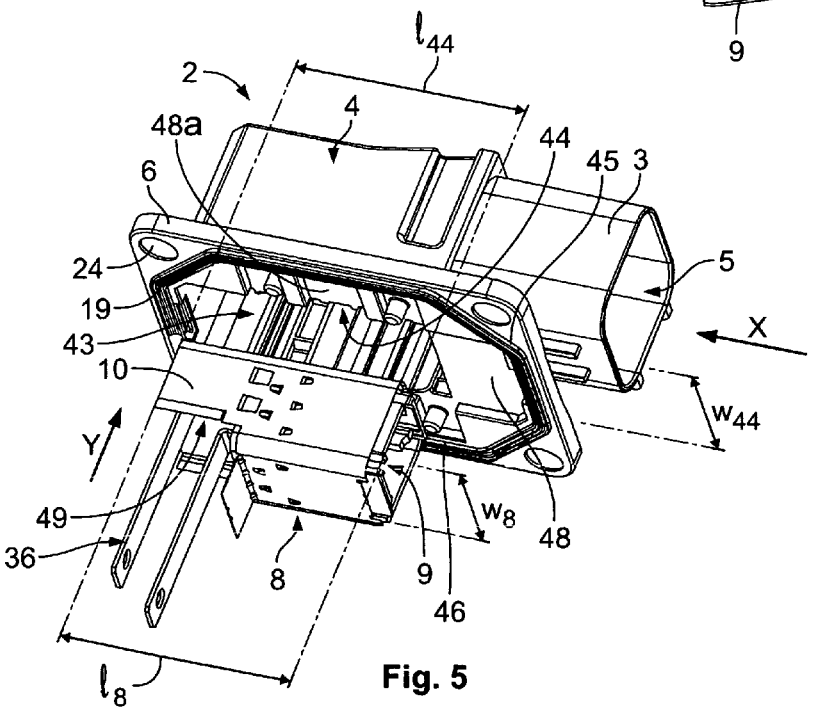
Figure 6:
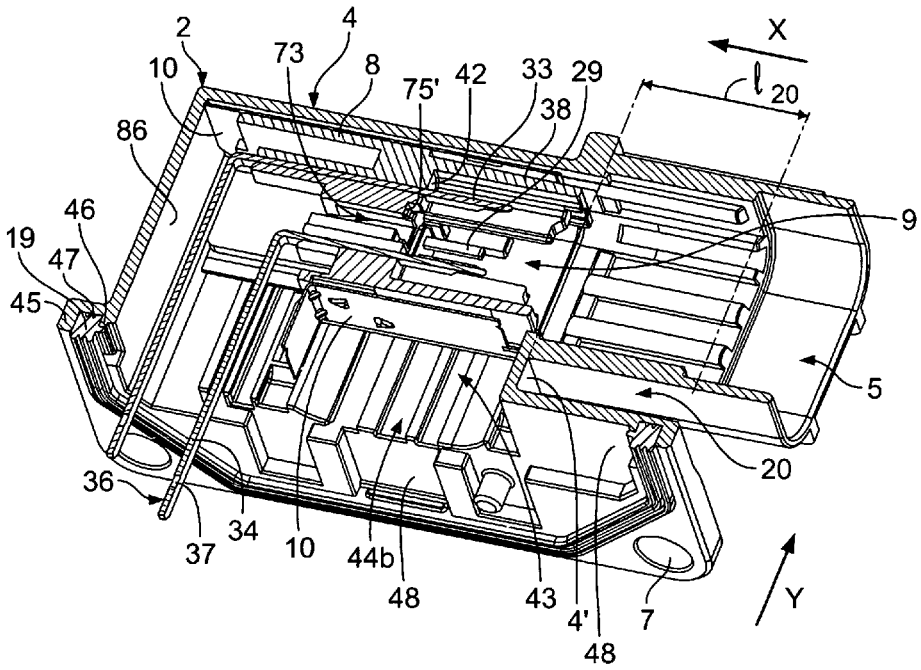
Figure 7:
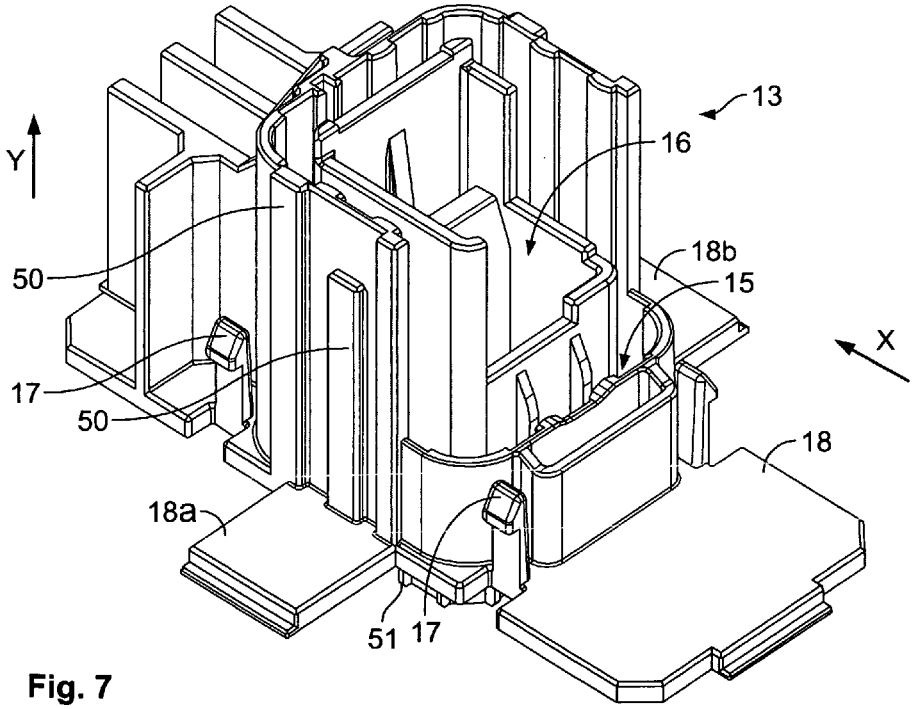
Figure 8:
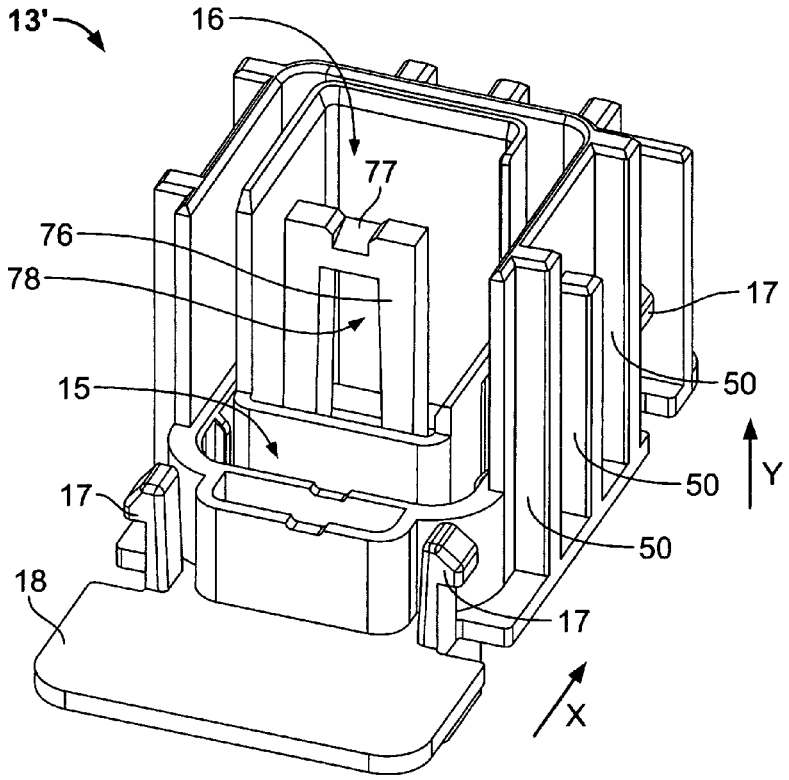
Figure 9:
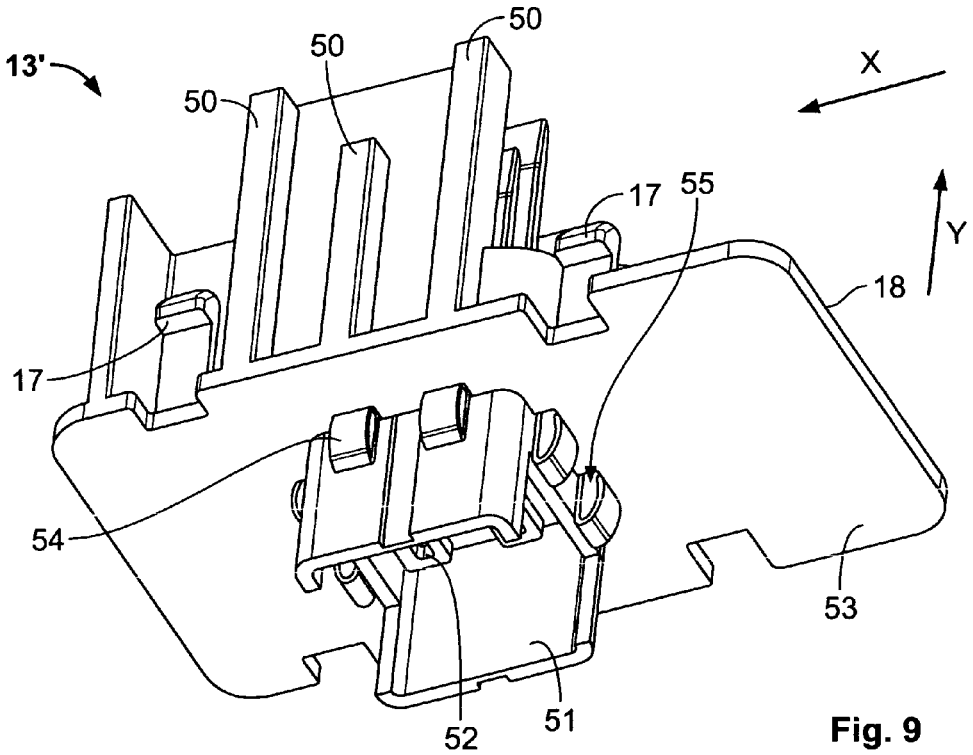
Figure 10:
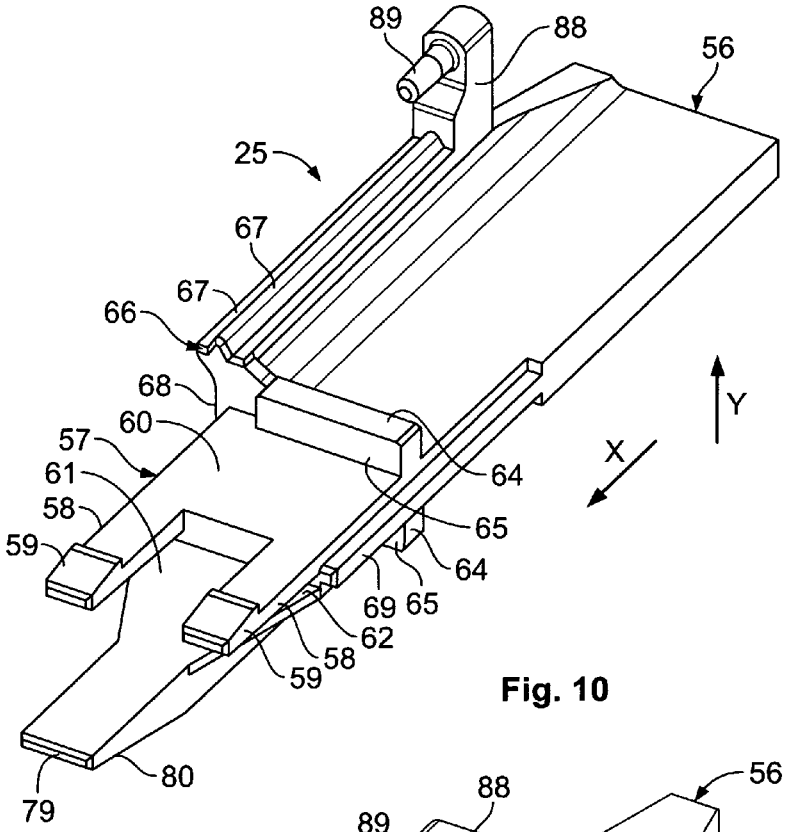
Figure 11:
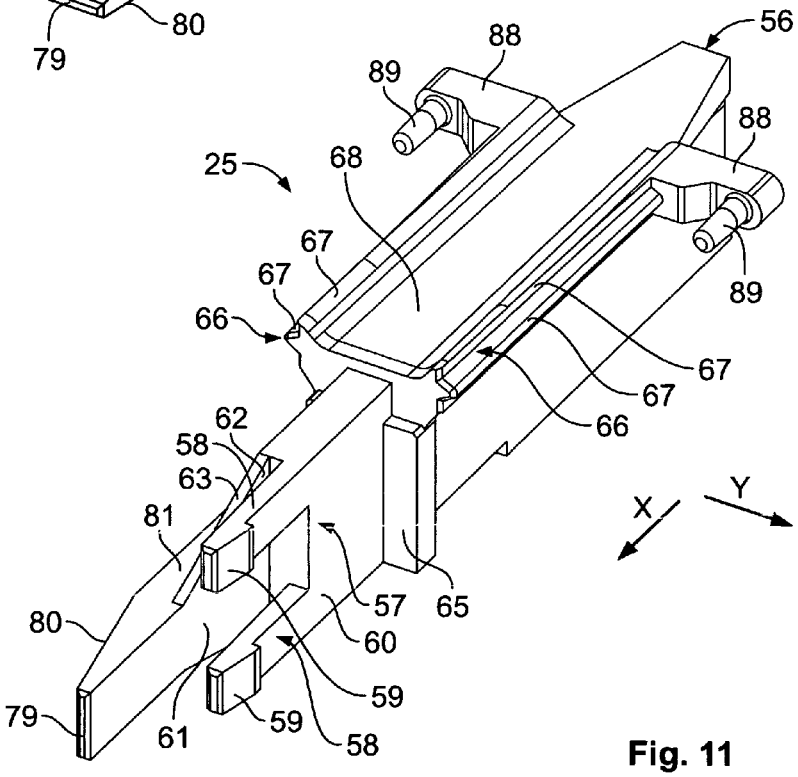
Figure 12:
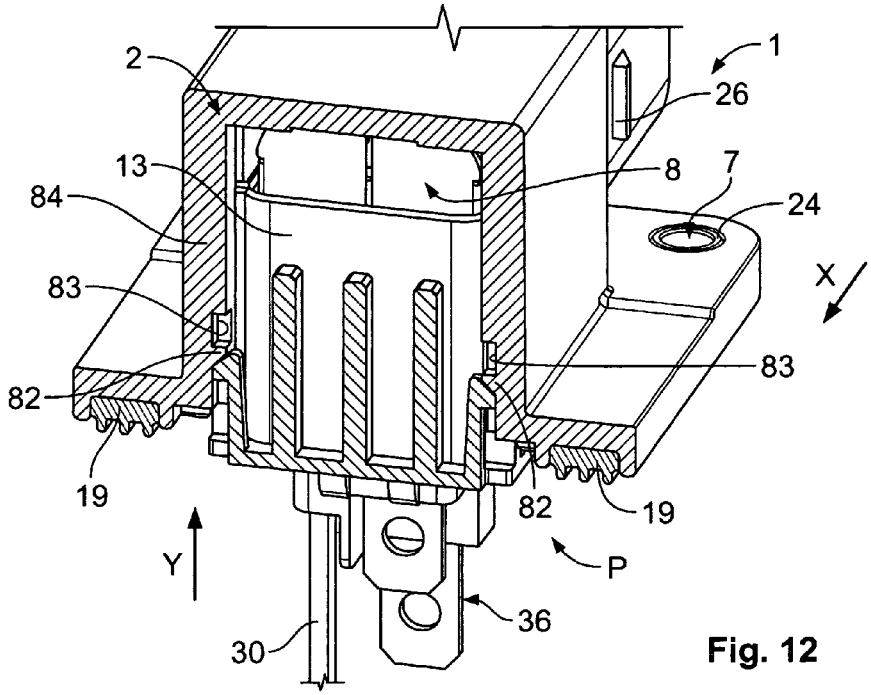
Figure 13:
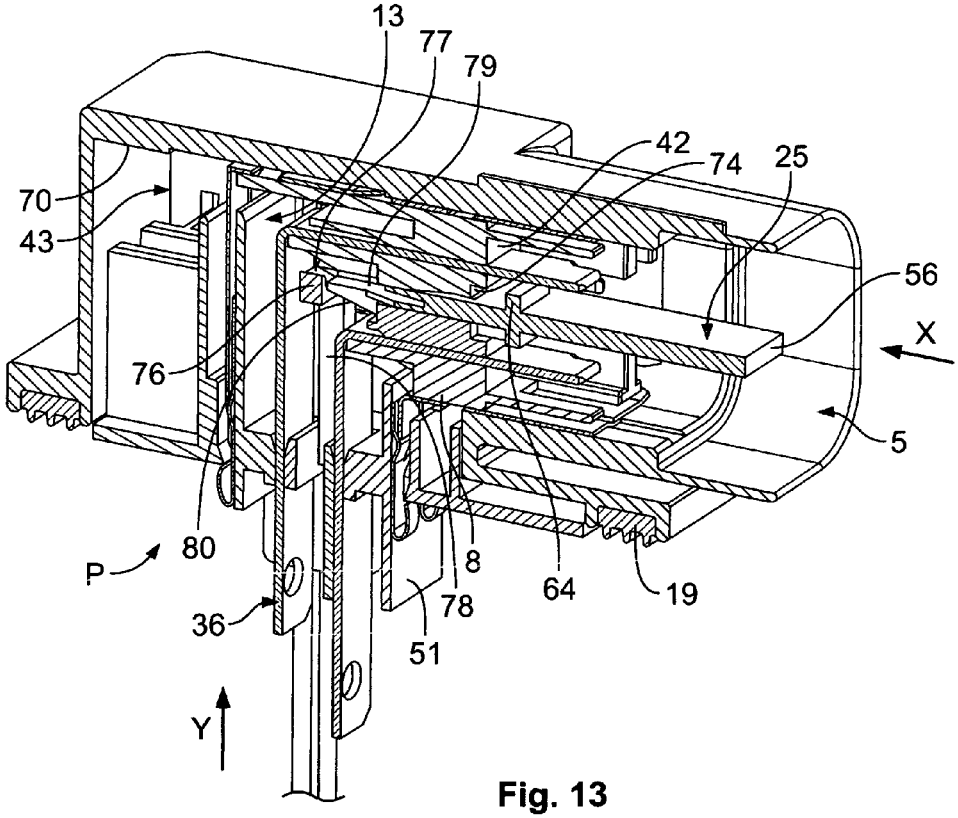
Figure 14:
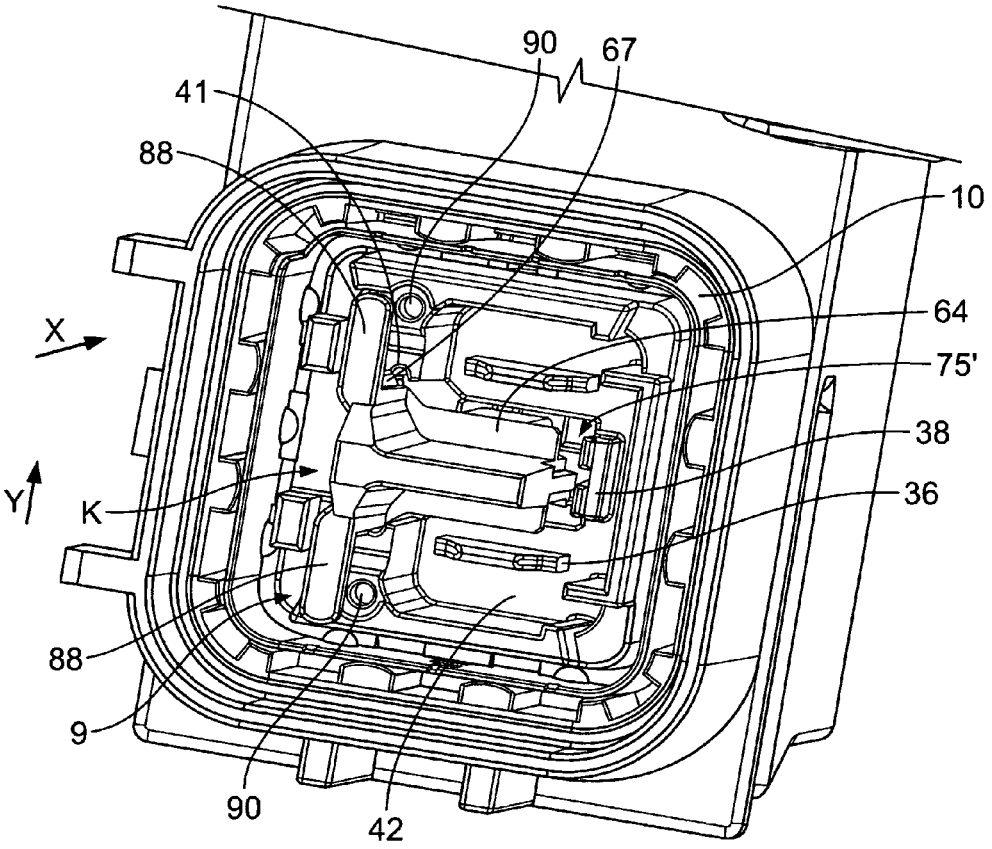
Figure 15:
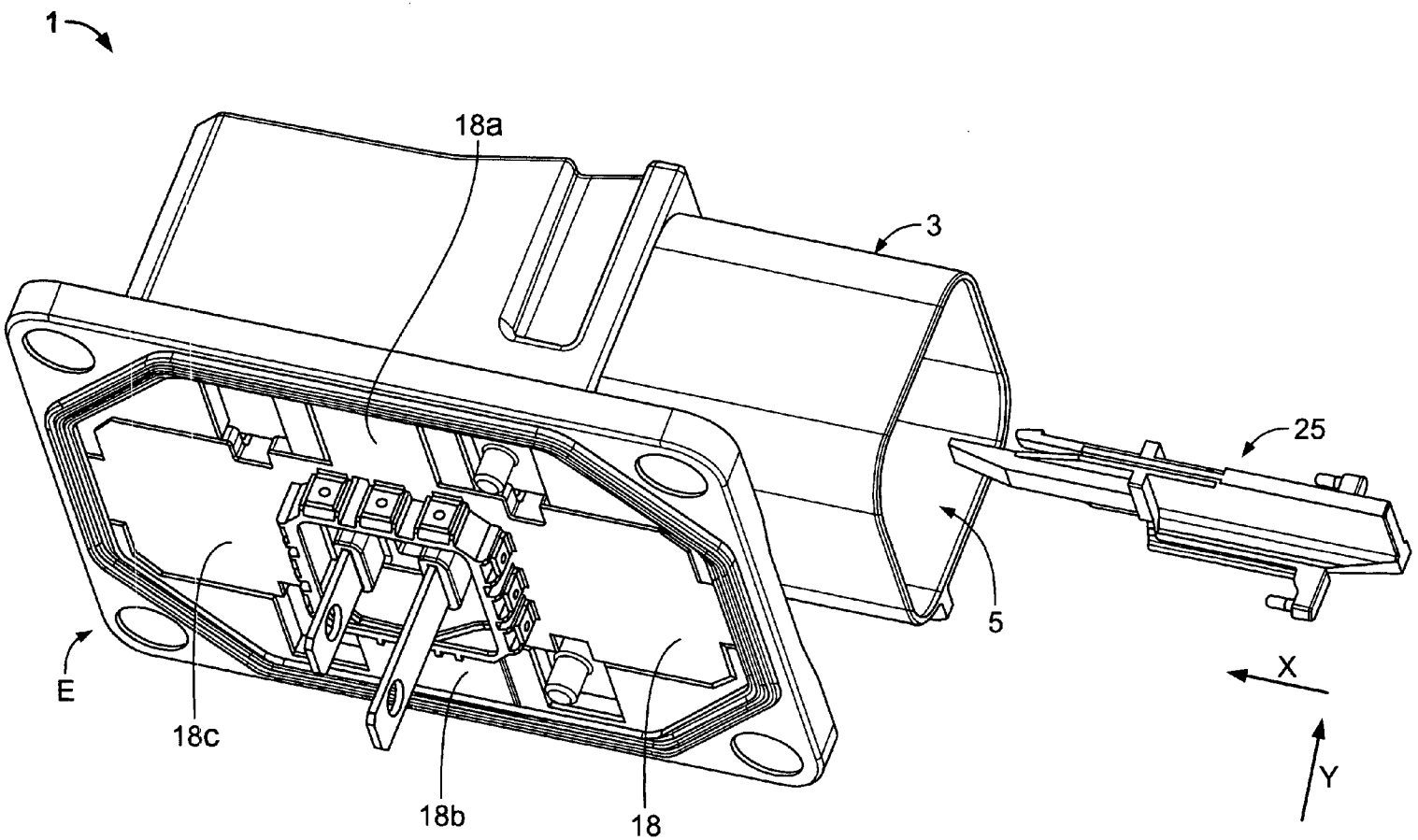
Figure 16:
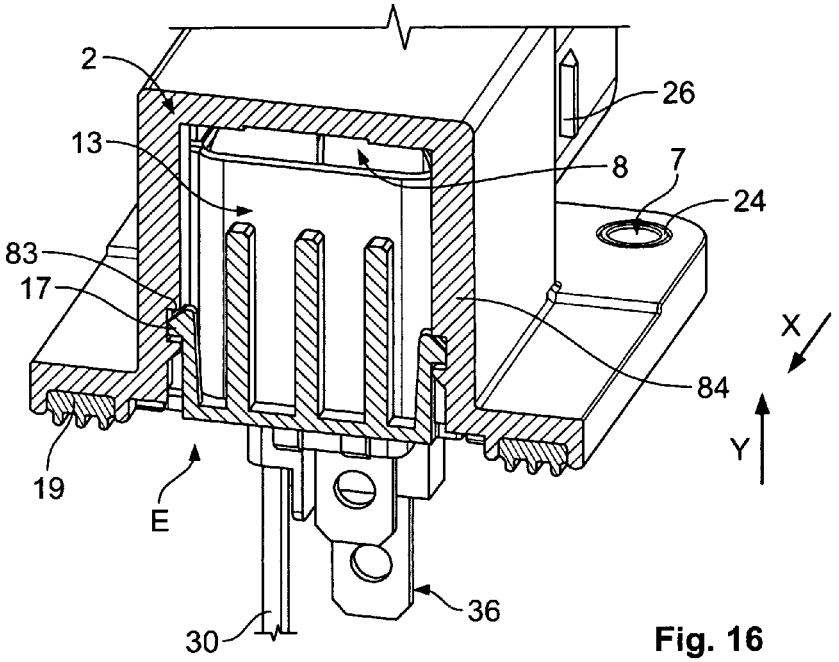
Figure 17:
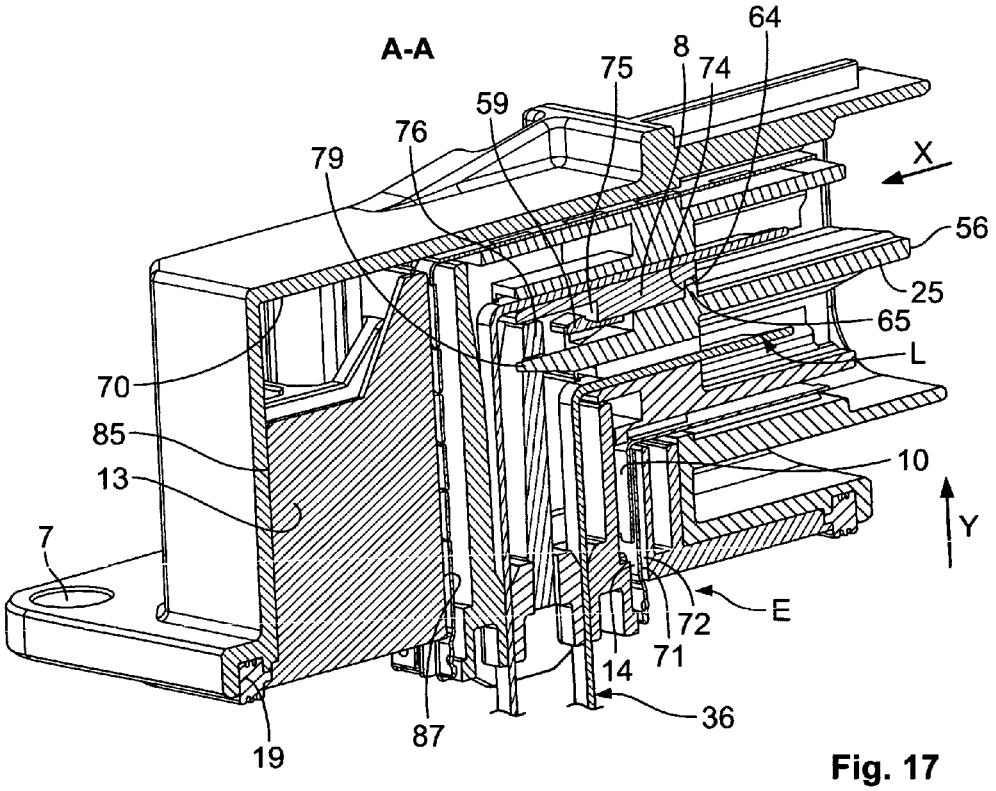
Figure 18:
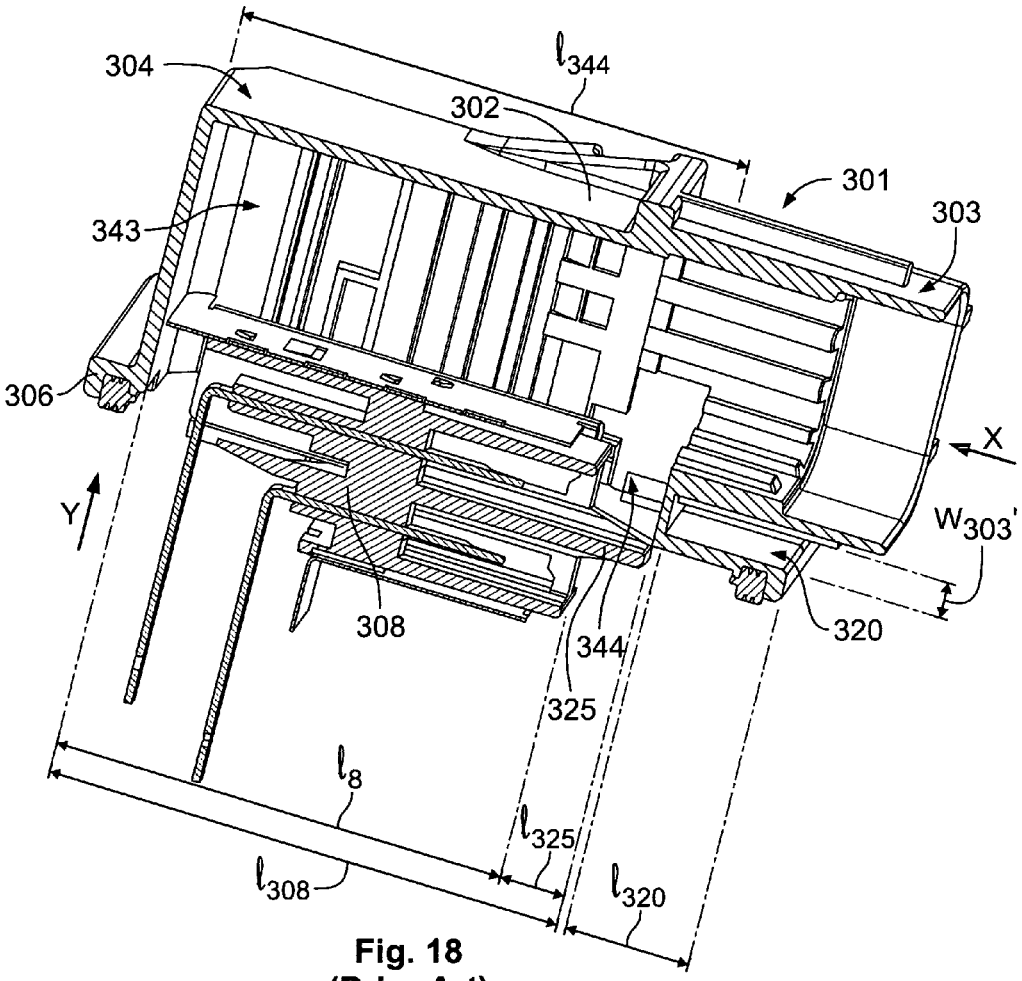
Fig. 18 (Prior Art)
Figure 19:
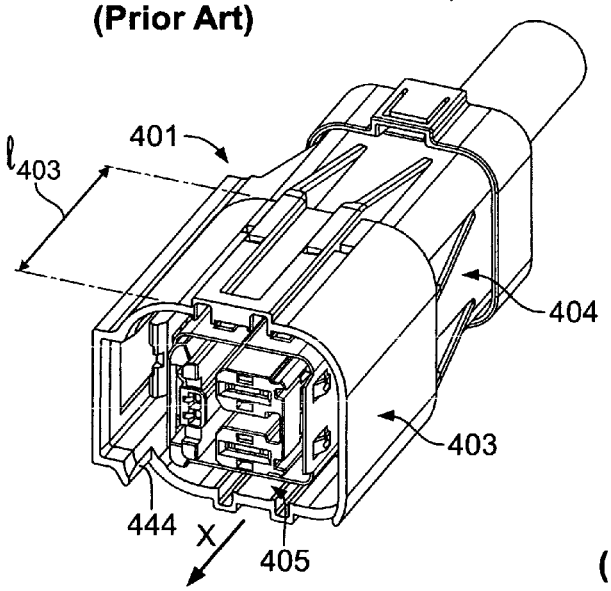
Fig. 19 (Prior Art)
Figures 20, 21:
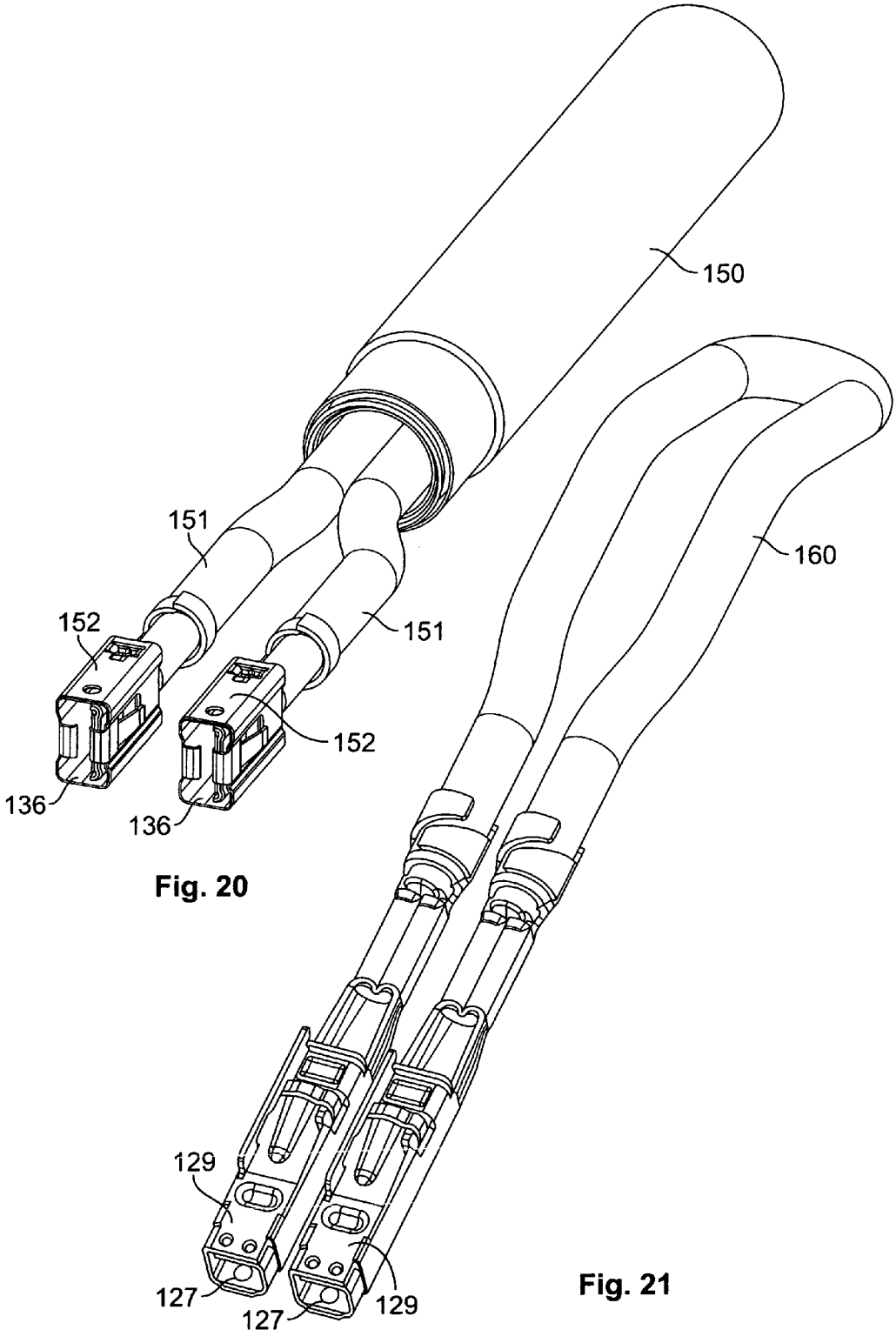
Figure 22:
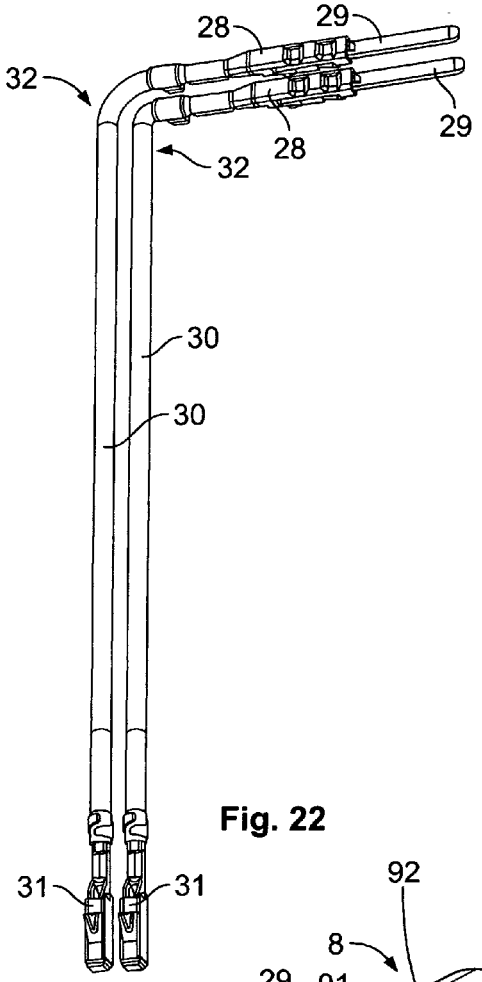
Figure 23:
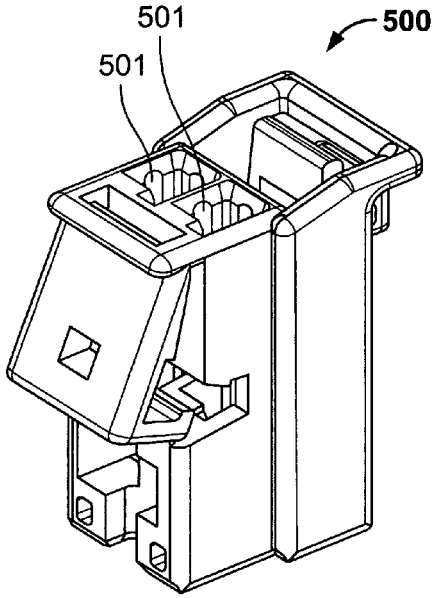
Figure 24:
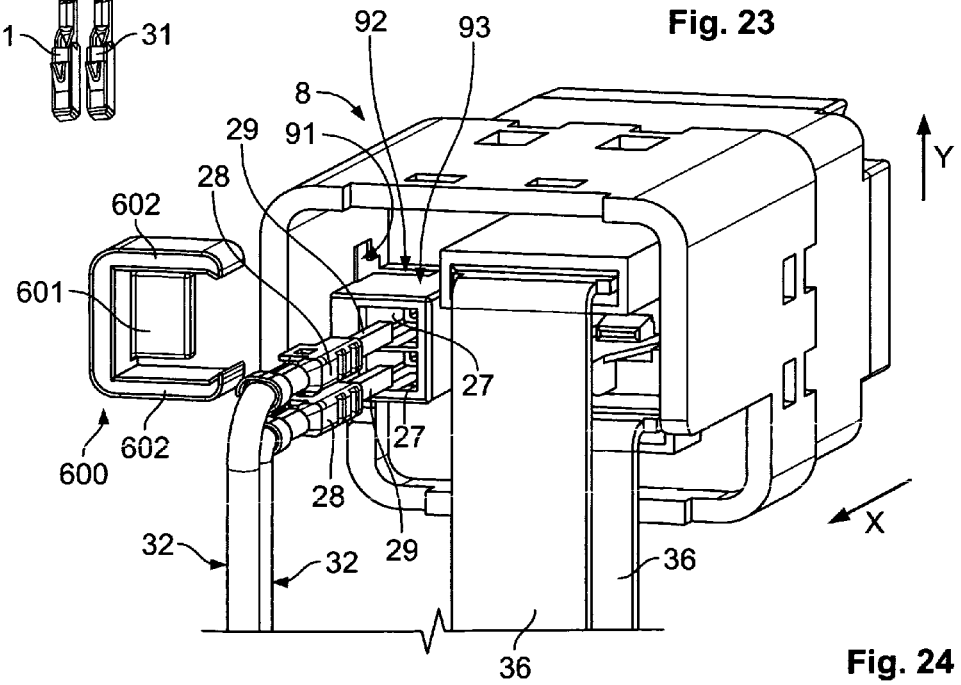
Figure 25:
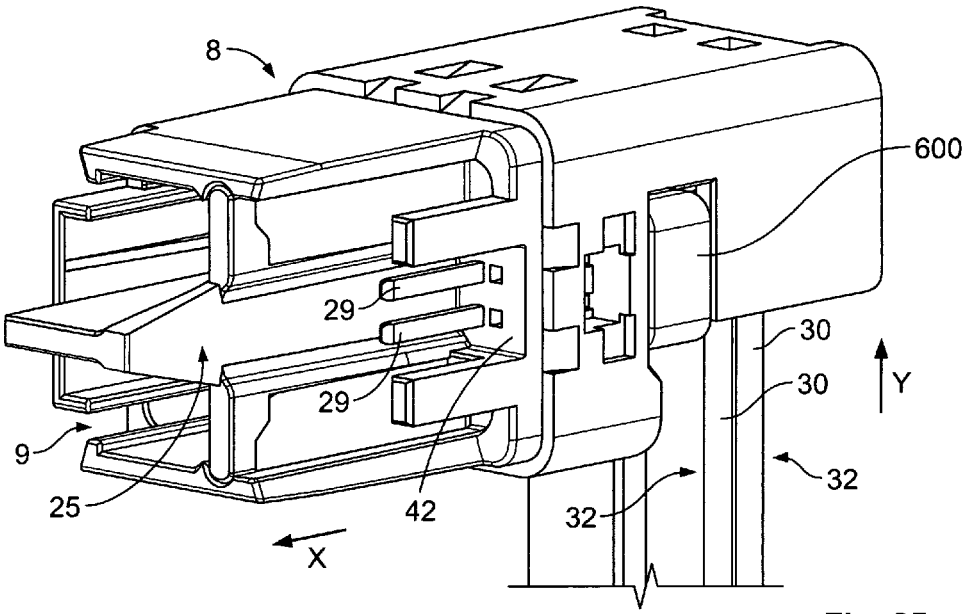
Figure 26:
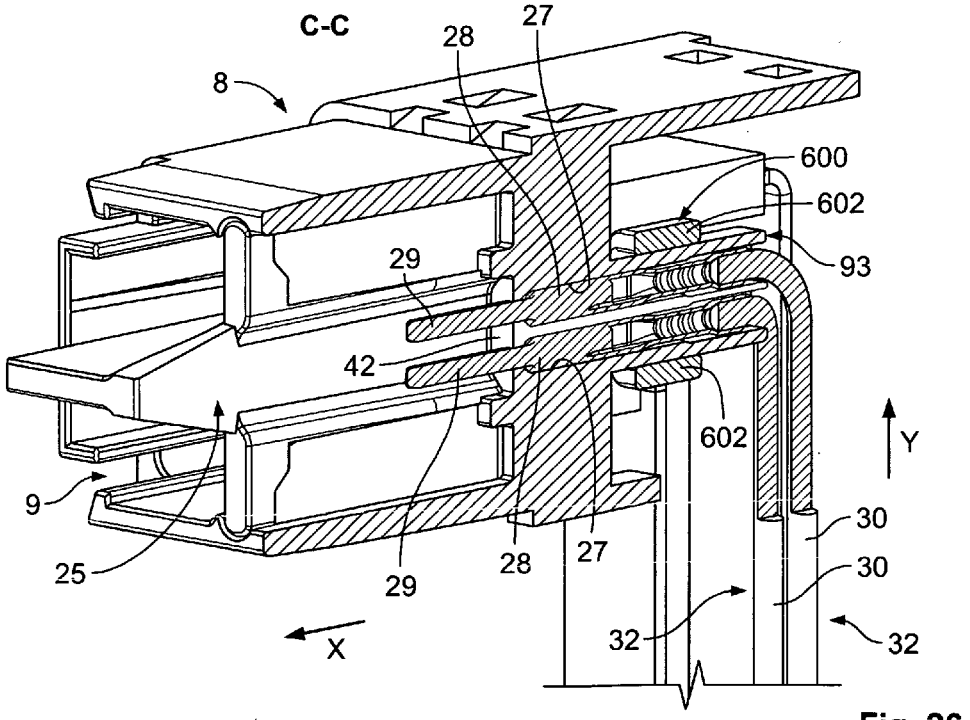
Figure 27:
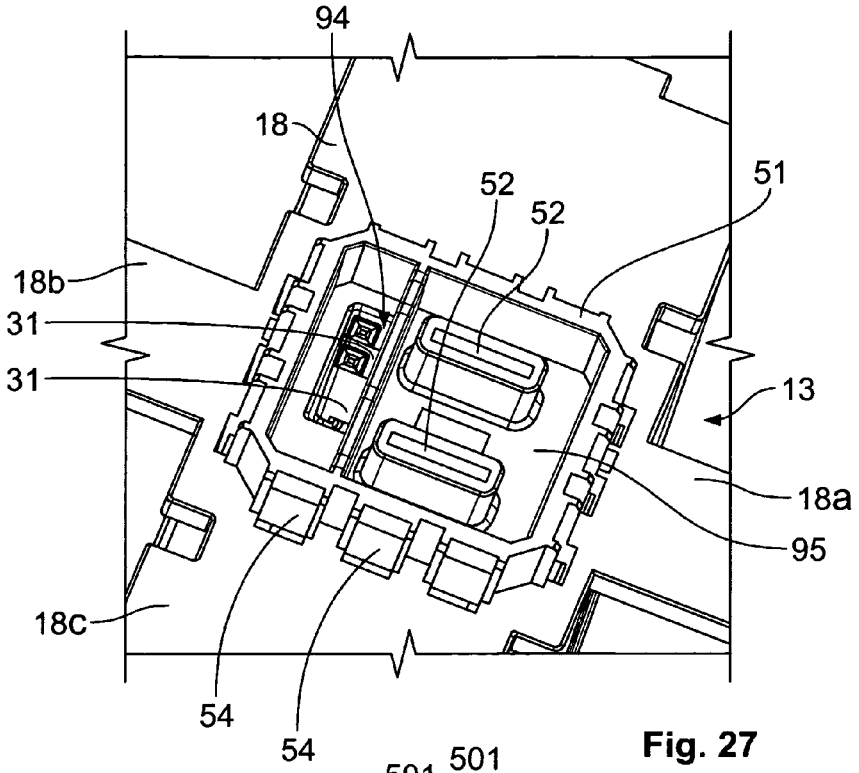
Figure 28:
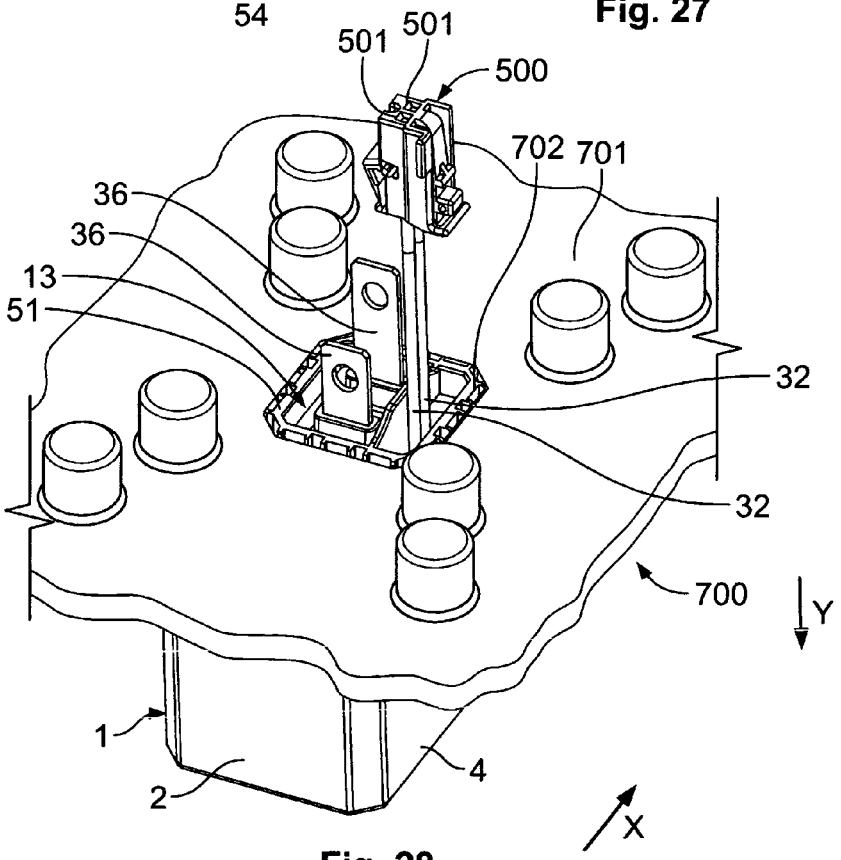
Figure 29:
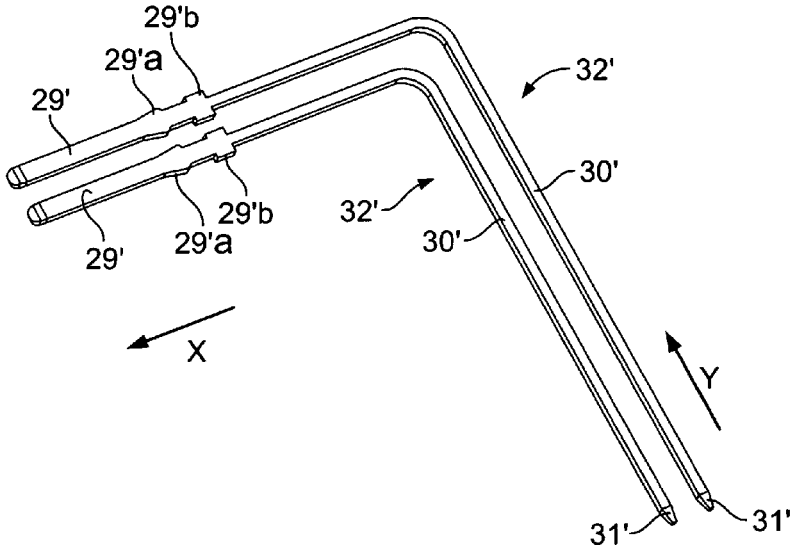
Figure 30:
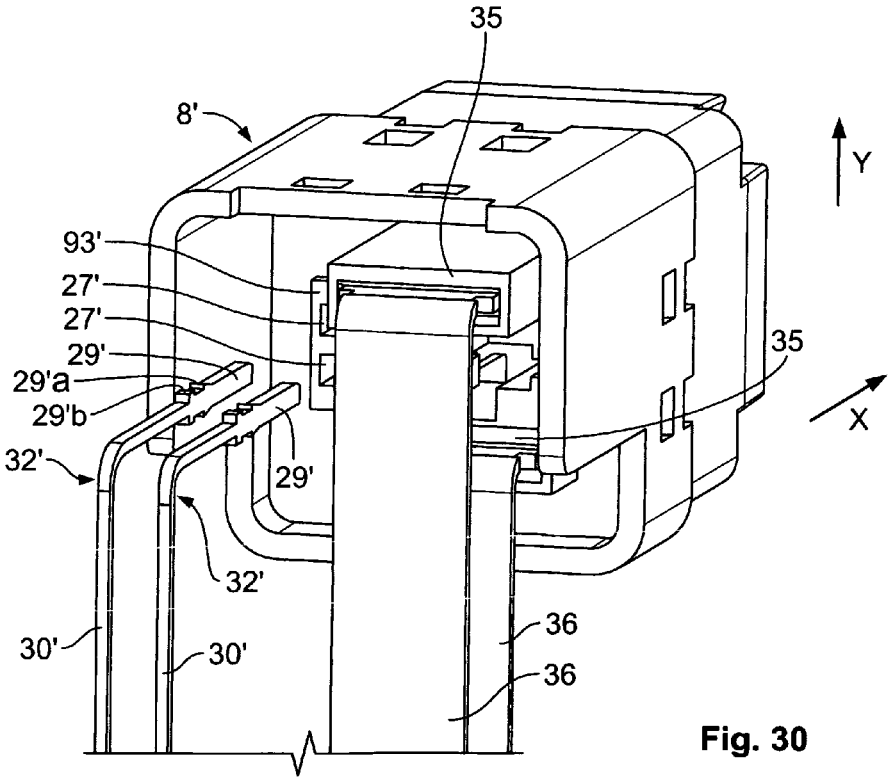
Figure 31:
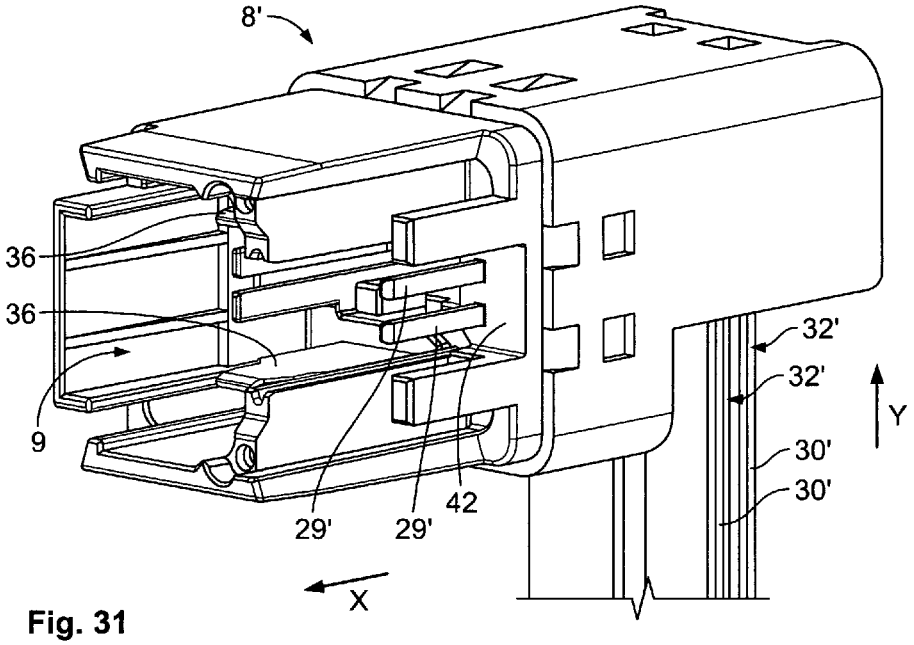
Figure 32:
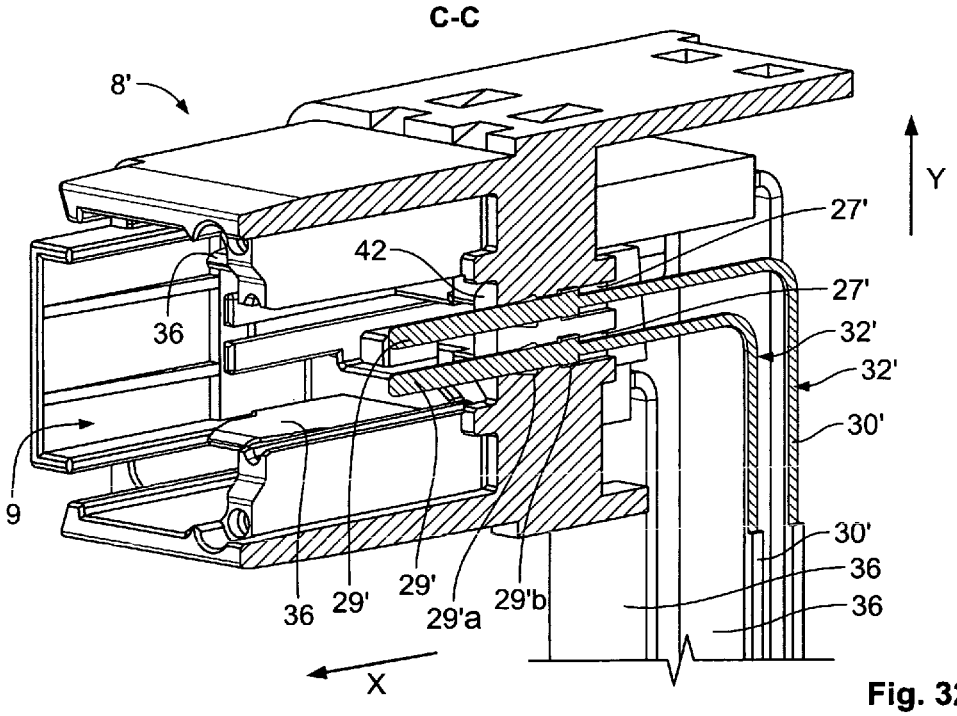
Figure 33:
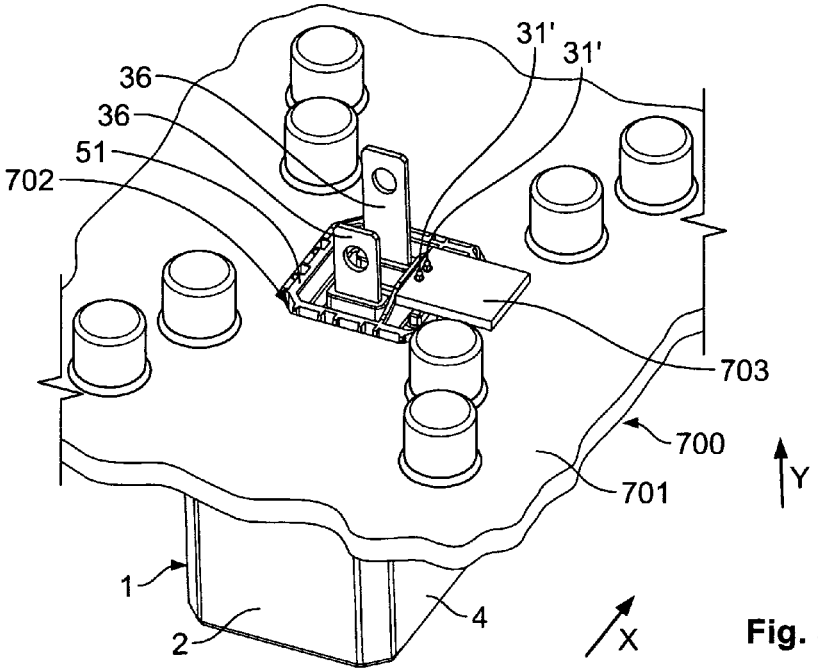
Figure 34:
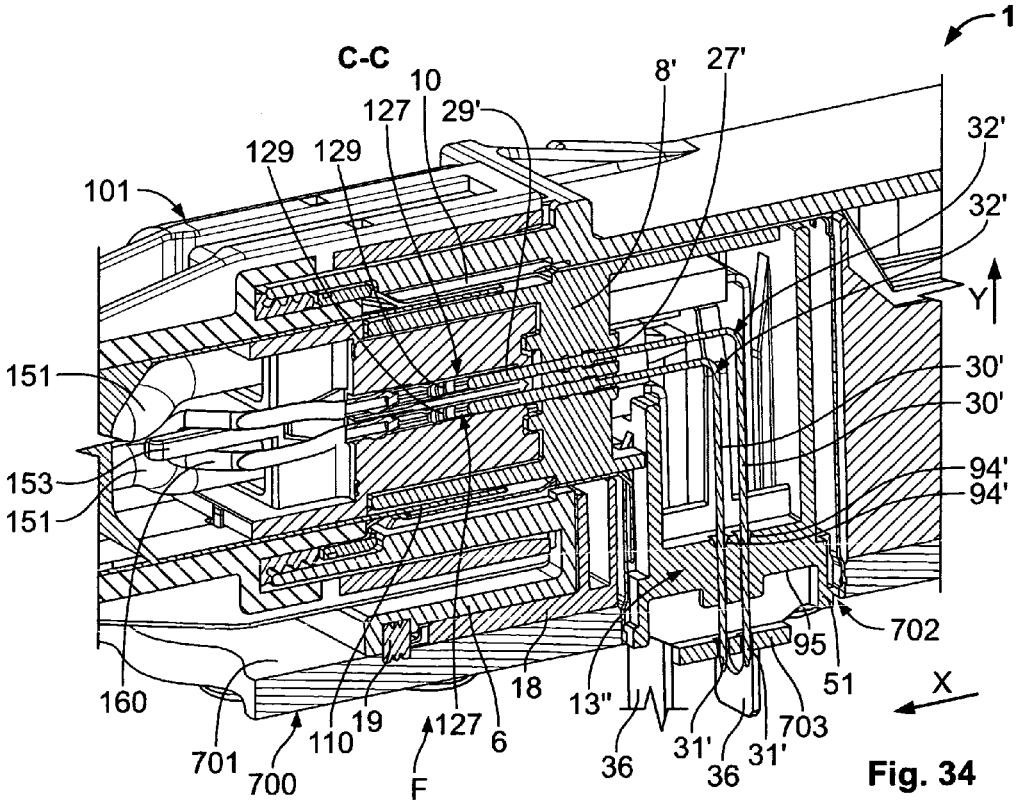
Figure 35:
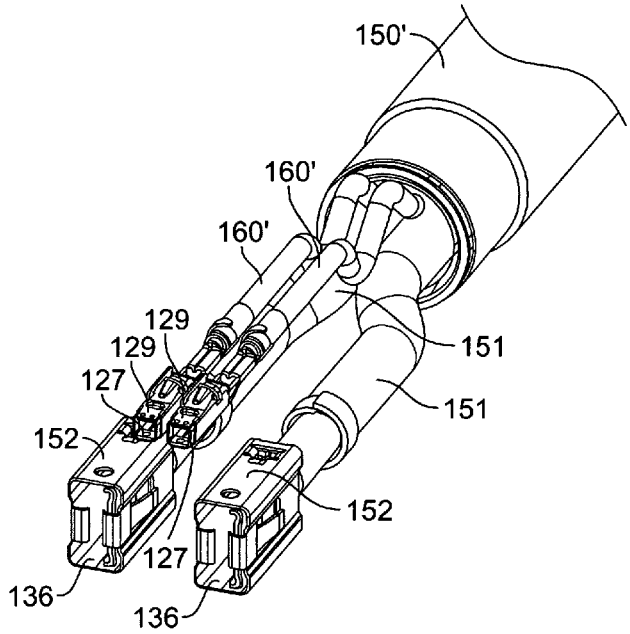
Figure 36:
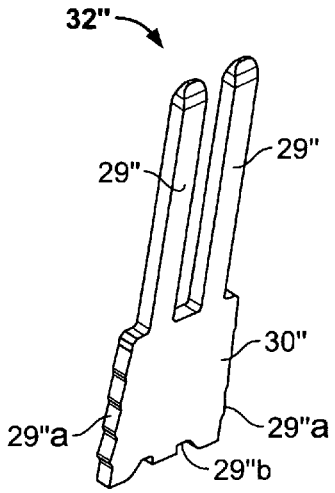
Figure 37:
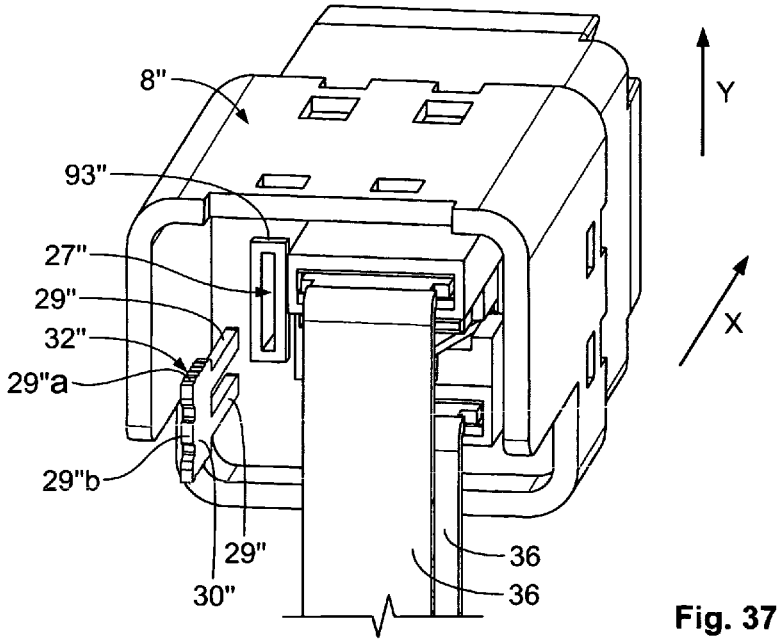
Figure 38:
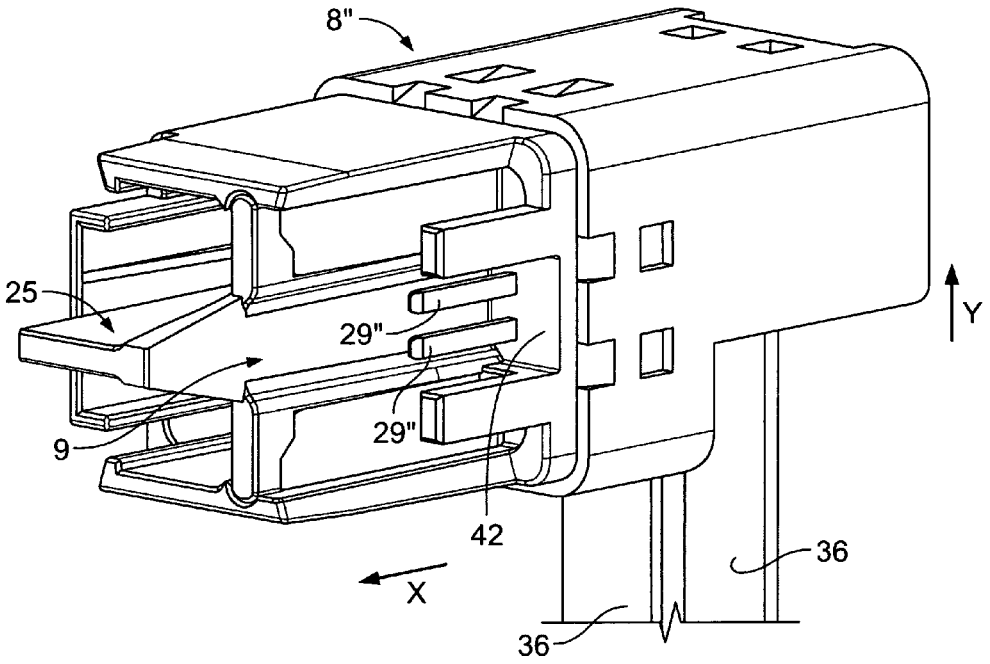
Figure 39:
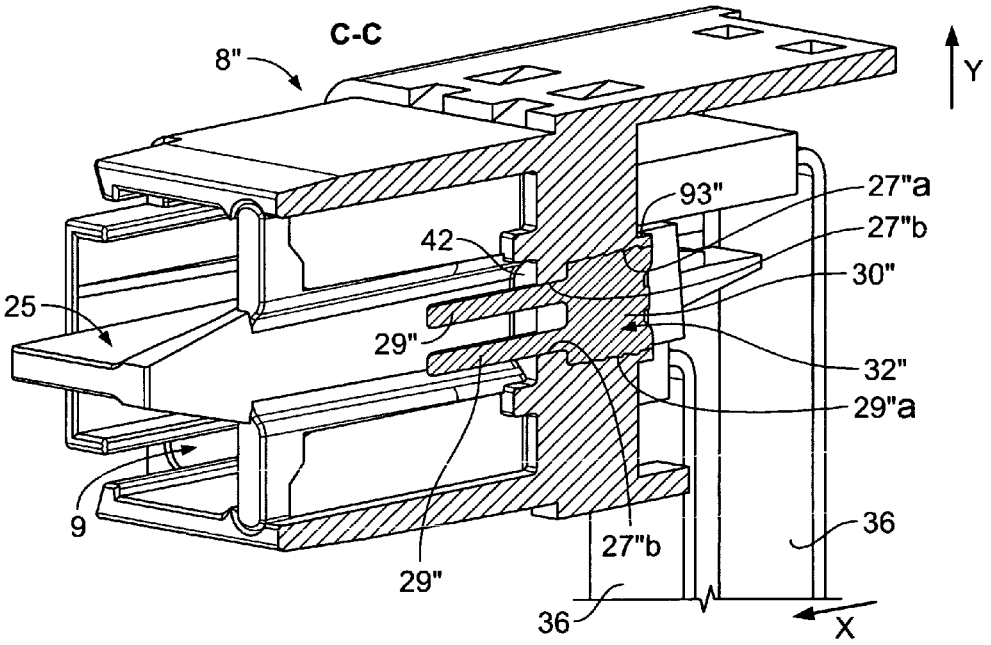
Figure 40:
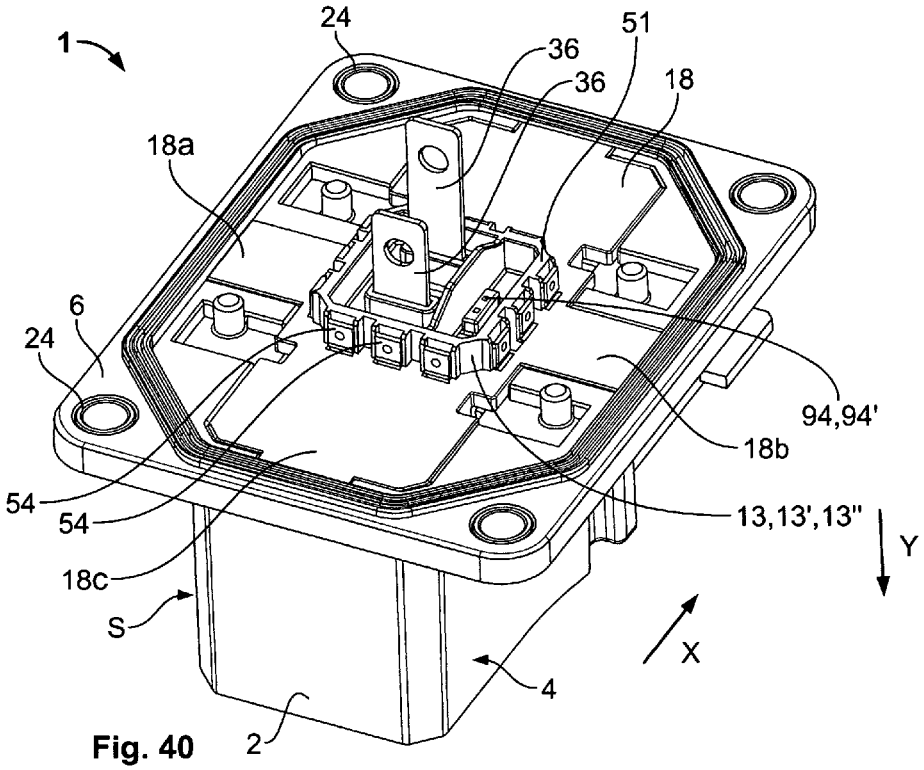
Figure 41:
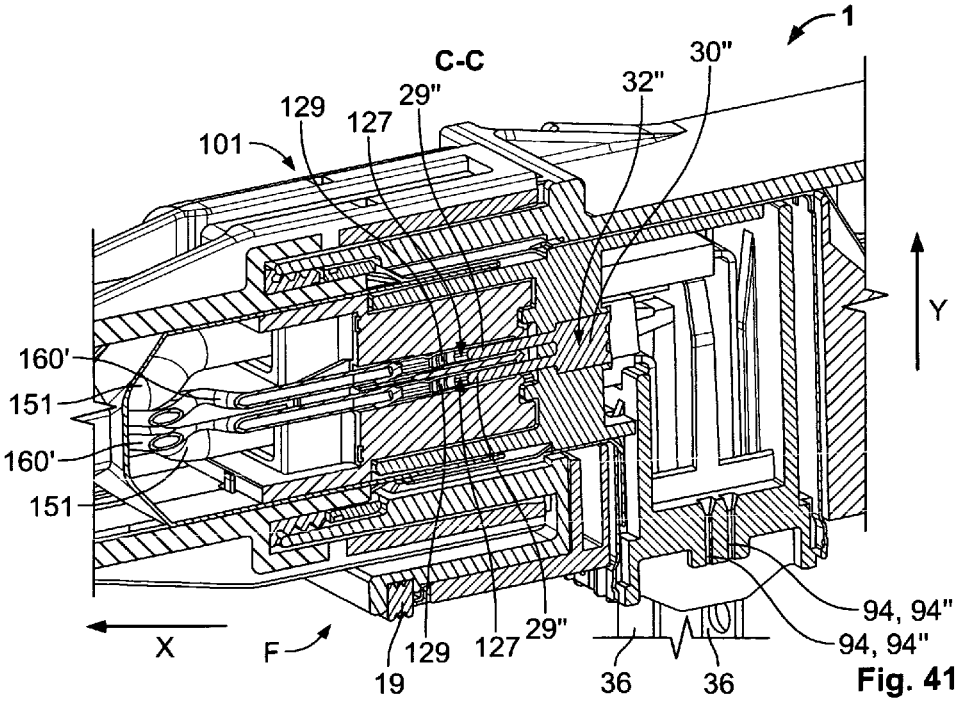

The invention will be described in more detail by way of example hereinafter using advantageous embodiments and with reference to the drawings. The described embodiments are only possible configurations in which the individual features may however, as described above, be implemented independently of each other or may be omitted. Equal elements illustrated in the drawings are provided with equal reference signs. Parts of the description relating to equal elements illustrated in different drawings are left out. In the drawings:

FIG. 1. is a schematic perspective exploded view of a plug-in connector according to an embodiment of the present invention;

FIG. 2. is a schematic perspective view of a mating plug-in connector mateable with a plug-in connector according to the present invention;

FIG. 3. is a schematic perspective cross-sectional view of a plug-portion terminal housing according to an embodiment of the present invention along a cross-section line C-C in FIG. 1;

FIG. 4. is a schematic perspective view of a plug-portion terminal housing according to an embodiment of the present invention provided with a plug-portion shielding;

FIG. 5. is a schematic perspective view of the plug-portion terminal housing of FIG. 4 ready to be inserted into an outer body of a plug-in connector according to the present invention;

FIG. 6. is a schematic perspective cross-sectional view along a cross-section line B-B in FIG. 1;

FIG. 7. is a schematic perspective view of a mounting section terminal housing according to an embodiment of the present invention;

FIG. 8. is a schematic perspective view of another embodiment of a mounting section terminal housing according to the present invention;

FIG. 9. is a schematic perspective view of the mounting section terminal housing shown in FIG. 8 from below, provided with a mounting section shielding;

FIG. 10. is a schematic perspective view of a finger protection member according to an embodiment of the present invention;

FIG. 11. is another schematic perspective view of the finger protection member shown in FIG. 10;

FIG. 12. is a schematic perspective cross-sectional view of a plug-in connector according to an embodiment of the present invention, wherein the mounting section terminal housing is in a near-end position along a cross-section line D-D in FIG. 1;

FIG. 13. is a schematic perspective cross-sectional view of the plug-in connector shown in FIG. 16 along the cross-section line C-C in FIG. 1;

FIG. 14. is a schematic perspective view into the plug-face of a plug-in connector according to the present invention;

FIG. 15. is a schematic perspective view of a plug-connector according to the present invention, wherein the mounting section terminal housing is latched in an end position;

FIG. 16. is a schematic perspective cross-sectional view of a plug-in connector according to the present invention along the cross-section line D-D in FIG. 1;

FIG. 17. is a schematic perspective cross-sectional view of the plug-in connector shown in FIG. 18 along the cross-section line A-A in FIG. 1;

FIG. 18. is a cross-sectional perspective view of a finger protection member formed at a plug-portion terminal housing ready to be inserted into an outer body of a plug-in connector according to the prior art;

FIG. 19. is a schematic perspective view of a mating plug-in connector according to the prior art;

FIG. 20. is a schematic perspective view of a main electrical line for a mating plug connector;

FIG. 21. is a schematic perspective view of an mating interlock member for a plug-in connector;

FIG. 22. is a schematic perspective view of interlock members which are compatible to the plug-portion terminal housing shown in FIGS. 1, 3 to 6, 13, 14 and 17 above;

FIG. 23. is a schematic perspective view of an interlock terminal housing;

FIG. 24. is a schematic perspective view an embodiment of a plug portion terminal housing according to the present invention and the interlock members shown in FIG. 22 which are ready to be inserted into the plug-portion terminal housing;

FIG. 25. is a schematic perspective view of the plug portion terminal housing shown in FIG. 24 equipped with the interlock members shown in FIG. 22;

FIG. 26. is a perspective cross-sectional view of the plug-portion terminal housing and interlock members shown in FIG. 25 along the cross-sectional line C-C in FIG. 1;

FIG. 27. is a detail of a schematic perspective view of an underside of a mounting section terminal housing according to an embodiment of the present invention accommodating the interlock members shown in FIG. 22;

FIG. 28. is another schematic perspective view of the mounting section terminal housing and the interlock members shown in FIG. 27, the interlock members being provided with the interlock terminal housing shown in FIG. 23;

FIG. 29. is a schematic perspective view of another embodiment of interlock members which are compatible to the embodiment of a mating interlock member shown in FIG. 21;

FIG. 30. is a schematic perspective view of another embodiment of a plug-section terminal housing according to the present invention and the interlock members shown in FIG. 29 which are ready to be inserted into the terminal housing;

FIG. 31. is a schematic perspective view of the plug-section terminal housing equipped with the interlock members shown in FIG. 30;

FIG. 32. is a schematic perspective cross-sectional view of the plug-section terminal housing and the interlock members shown in FIG. 31 along the cross-sectional line C-C in FIG. 1;

FIG. 33. is a schematic perspective view of the underside of a plug-in connector according to the present invention equipped with an embodiment of a mounting section terminal housing;

FIG. 34. is a schematic perspective cross-sectional view of an embodiment of a plug-in connector and a mating plug-in connector according to the present invention in a fully mated state;

FIG. 35. is a schematic perspective view of another embodiment of a main electrical line with integrated mating interlock members;

FIG. 36. is a schematic perspective view of another embodiment of an interlock member according to the present invention;

FIG. 37. is a schematic perspective view of another embodiment of a plug-section terminal housing according to the present invention and the interlock member shown in FIG. 36 ready to be inserted into the plug-section terminal housing;

FIG. 38. is a schematic perspective view of the plug-section terminal housing shown in FIG. 37 accommodating the interlock member shown in FIG. 36;

FIG. 39. is a schematic perspective cross-sectional view of the plug-portion terminal housing and the interlock member shown in FIG. 38 along the cross-sectional line C-C in FIG. 1;

FIG. 40. is a schematic perspective view of the underside of a plug-in connector according to the present invention in the assembled state; and FIG. 41. is a schematic perspective cross-sectional view of the plug-in connector shown in FIG. 40 and a mating plug-in connector equipped with the main electrical line having an integrated mating interlock member shown in FIG. 35 in a fully mated state along the cross-sectional line C-C in FIG. 1.

At first, an electrical plug-in connector 1 is described with reference to FIG. 1 which shows the plug-in connector 1 in a schematic perspective exploded view. The plug-in connector 1 comprises an outer body 2 having a plug portion 3 and a mounting section 4. The plug portion 3 has a plug opening 5 which opens towards a plug-in direction X of the plug-in connector 1. The mounting section 4 serves for mounting the plug-in connector 1 to an electrical device and is therefore provided with a base 6 having mounting supports 7 in the form of through holes. The mounting supports 7 and a mounting opening (not yet shown) of the outer body 2 open towards a mounting direction Y which runs perpendicularly to the plug-in direction X.

A plug-portion terminal housing 8 of the plug-in connector 1 has a plug-face 9. The plug-face 9 of the plug-portion terminal housing opens towards the plug-in direction X. The plug-portion terminal housing 8 is arranged underneath the outer body 2 in order to be inserted into the outer body 2 in the mounting direction Y.

A plug-portion shielding 10 of the plug-in connector 1 comprises a first shielding element 11 and a second shielding element 12. The first shielding element 11 and the second shielding element 12 are arranged at the height of the plug-portion terminal housing 8 in the mounting direction Y. The plug portion shielding is to be attached to the plug-portion terminal housing 8 by being moved in the plug-in direction X in order to at least partially accommodate the plug-portion terminal housing 8.

A mounting section terminal housing 13 of the plug-in connector 1 is arranged in the mounting direction Y below a mounting section shielding element 14 of the plug-in connector 1. The mounting section shielding element 14 is ready to be inserted into a shielding receptacle 15 of the mounting section terminal housing 13. The shielding receptacle 15 surrounds a mounting socket 16 of the mounting section terminal housing 13. Further, the mounting section terminal housing 13 is provided with latching elements 17 which serve to fix the mounting section terminal housing 13 within the outer body 2. A closure members 18, 18*a* of the mounting section terminal housing designed to abut the outer body 2 from below.

A sealing element 19 is arranged below the mounting section terminal housing 13 in the mounting direction Y. The sealing element 19 is shaped such that it fits into an area surrounded by the mounting supports 7 in the base 6 of the outer body 2. A sealing orifice 21 of the sealing element is formed such that it may accommodate an outer contour of the mounting section terminal housing 13.

Bushings 24 of the plug-in connector 1 are arranged above the sealing element 19 and aligned with the mounting supports 7 of the outer body 2 in the mounting direction Y.

A finger protection member 25 of the plug-in connector 1 is arranged at the height of the plug opening 5 of the outer body 2 in order to be inserted into the outer body 2 through the plug opening 5 in the plug-in direction X.

When a mating plug-in connector (not yet shown) is mated with the plug-in connector 1, it is plugged into the plug opening 5 and locked in a plug position where it is fully mated with the plug-in connector 1 in a mating position M of the plug-in connection with the help of plug latching members (not yet shown) formed at the plug-portion 9. Further, in the mating position M the mating plug portion (not yet shown) surrounds the plug portion 3 and partially juts into a notch or slid 20 formed between a lower side of an outer wall of the plug portion 3 and an upper side of the base 6.

FIG. 2 shows an electrical mating plug-in connector 101 according to an embodiment of the present invention in a schematic perspective view. The mating plug-in connector 101 has an outer body 102 which similarly to the plug-in connector 1 is provided with a mating plug portion 103 and a mounting section 104. The mating plug portion 103 has a length $l_{103}$ and is provided with a mating plug opening 105 which opens in the plug-in direction X.

A mating plug-portion terminal housing 108 of the mating plug-in connector 1 is provided within the mating plug opening 105 and provides for a mating plug face 109 which is designed to engage, i.e. mesh with the plug face 9 of the plug-in connector 1. A mating plug-portion shielding 110 surrounds the mating plug-portion terminal housing 108 and is designed to overlap with the plug-portion shielding 10 when the mating plug-in connector 101 is plugged into the plug-in connector 1 and fully mated therewith in the mating position M, wherein the plug-in connector 1 and the mating plug-in connector 101 together constitute an electrical connector (not shown) according to an embodiment of the present invention.

The mating plug-in connector 101 further comprises a finger protection member receptacle 125 which is designed to accommodate the finger protection member 25 in the mating position M. Mating plug latching members 126 in the form of openings within sidewalls of the mating plug portion 103 are designed to interact with the plug latching members (not yet shown) of the plug-in connector 1 in that the mating plug latching members 126 in the form of through holes engage with the plug latching members (not yet shown) having the form of nibs.

Further, the mating plug face 109 has sockets 136 comprising mating terminals (not shown) which are designed to take up and electrically contact electrical contacts (not yet shown) in the form of contact pins of the plug-in connector 1. The mating plug face 109 further comprises mating interlock contacts 129 in the form interlock contact sockets which are arranged to electrically contact interlock contacts (not yet shown) of the plug-in connector 1.

Finally, the mating plug-in connector 101 is provided with a main electrical line 150 in the form of an electrical cable with a conductor entering the mounting section 104 of the mating plug-in connector 101 in the plug-in direction X.

FIG. 3 is a schematic perspective cross-sectional view of the plug-portion terminal housing 8 along the cross-sectional line C-C in FIG. 1. The cross-section cuts interlock contact receptacles 27 of the plug-portion terminal housing 8 parallel to the plug-in direction X which accommodate interlock terminals 28 providing interlock contacts 29 in the form of pins for contacting, i.e. jutting into the mating interlock contacts 129 within the mating interlock receptacle 127. Interlock electrical lines 30 in the form of cables are fixed to the interlock terminals 28 in an electrically conductive manner at an end of the interlock electrical lines 30. Interlock mounting terminals 31 are fixed to the interlock electrical lines 30 at another end of the interlock electrical lines 30. The interlock terminal 28, the interlock contact 29, the interlock electrical lines 30 an the interlock mounting terminals 31 together form an interlock member 32 of the plug-in connector 1.

Electrical contacts 36 are held in electrical contact carriers 35 in the form of contact receptacle through holes of the plug-portion terminal housing 8. The electrical contacts 36 have a contact portion 33 formed as shafts in the form of contact pins extending within the plug face 9 of the plug-portion terminal housing 8 parallelly against the plug-in direction X. A contact mounting section 34 of each electrical contact 36 extends against the mounting direction Y. The contact mounting section 34 is provided with contact mounting supports 37 in the form of through holes which facilitate fixing an electrical conductor to the electrical contacts 36 solidly in an electrically conductive manner.

Further, the plug face 9 of the plug-portion terminal housing 8 is provided with a finger protection member guidance 38 which is formed by two ribs 40 running parallel to the plug-in direction X. Between the ribs 40, a guiding groove 41 is formed which runs parallel to the plug-in direction X.

FIG. 4 is a schematic perspective view of the plug-portion terminal housing 8 in a pre-assembled position where it is provided with the electrical contacts 36, the interlock members 32 and the plug-portion shielding 10 which surrounds the plug-portion terminal housing 8. The electrical contacts 36 are inserted into the electrical contact carriers 35 such that the contact mounting section 34 abuts the electrical contact carrier 35 and the contact portion 33 protrudes from the bottom 42 of the plug face 9 against the plug-in direction X.

FIG. 5 is a schematic perspective view of the outer body 2 and the plug-portion terminal housing 8. The plug-portion terminal housing 8 is ready to be inserted into an inner space 43 of the outer body 2 through a mounting opening 44 to the inner space 43. The inner space 43 opens towards the mounting direction Y through the mounting opening 44 and towards the plug-in direction X through the plug opening 5. A width $w_8$ and a length $l_8$ of the plug-portion terminal housing 8 are equal to or slightly smaller than a length $l_{44}$ and a width $w_{44}$, respectively, of the mounting opening 44.

Further, in FIG. 5 it becomes apparent that the base 6 of the outer body 2 at its underside is provided with an outer flange 45 and an inner flange 46 which extend towards the mounting direction Y and form between themselves a sealing groove 47 designed to accommodate the sealing element 19. Closure member abutments 48, 48*a* are formed within an area encircled by the inner flange 46 and face towards the mounting direction Y in order to abut with the closure members 18, 18*a*, respectively, of the mounting section terminal housing 13 when the mounting section terminal housing 13 is inserted into the outer body 2 until an end-position E is reached. The electrical contacts 36 exit the plug-portion shielding 10 through a shielding orifice 49.

FIG. 6 is a schematic perspective cross-sectional view of the outer body 2 of the plug-in connector 1 along cross-section line B-B shown in FIG. 1. The outer body 2 is in a pre-assembled position where the sealing element 19 is attached to the outer body 2. It becomes apparent that the notch or slid 20 is defined between a lower edge of the plug-portion 3 and an upper surface of the base 6. A length $l_{20}$ of the slid 20 is determined by a front edge of the base 6 facing towards the plug-in direction X and a front wall 4' of the mounting section 4. In the mating position M a maximum length $l_{max,\ 103}$ of the mating plug-portion 103 in the plug-in direction X in the area of the slid 20 is limited by the length $l_{20}$ of the slid 20.

FIG. 7 is a schematic perspective view of the mounting section terminal housing 13 according to an embodiment of the present invention. The mounting section shielding element 14 may be inserted into the shielding receptacle 15 against the mounting direction Y. At lateral sides of the mounting section terminal housing 13 webs 50 are formed which run parallel to the mounting direction Y and help guiding and fixing the mounting section terminal housing 13 within the outer body 2. On a side of the mounting section terminal housing 13 opposite the side to which the closure member 18*a* is provided, a further closure member 18*b* is formed at the mounting section terminal housing 13.

FIG. 8 is a schematic perspective view of another embodiment of a mounting section terminal housing 13' according to the present invention. The mounting section terminal housing 13' is provided with a blocking member 76 having a check notch 77 and a check cavity 78 in form of a through hole in the plug-in direction X. All other parts of the mounting section terminal housing 13' are essentially equal to the parts of the mounting section terminal housing 13 described with reference to FIGS. 1 to 7 above.

FIG. 9 is another schematic perspective view of the mounting section terminal housing 13 shown in FIG. 8. A grommet 51 of the mounting section terminal housing 13 protrudes from a downside of the mounting section terminal housing 13 below the closure member 18. The grommet 51 serves for protecting the electrical contacts 36 when they jut below the closure member 18 through contact openings 52 within a bottom 53 of the plug portion terminal housing 13.

In FIG. 9 it becomes apparent that shielding fixation members 54 of the mounting section shielding element 14 jut below the bottom 53 of the plug-portion terminal housing 13 through shielding fixation openings 55 within the bottom 53. The shielding fixation members 54 are formed as latches constituted by resilient lamellas extending downwardly in the mounting direction Y from the mounting section shielding element 14.

FIG. 10 is a schematic perspective view of a finger protection member 25 according to an embodiment of the present invention. The finger protection member 25 has a bar-like oblong shape extending in the plug-in direction X and is provided with a protection end 56 and a retention end 57 which serves as a fastening section. At the retention end 57 a retention organ 58 is formed which comprises retention elements 59 having the form of a latch and a retention guidance 60 in the form of a lug, both protruding from the retention end 57 in the plug-in direction X. The retention end 57 is further provided with a counter retention organ 61 having a counter retention element 62 in the form of a lug and a counter retention guidance 63 in the form of a bevel which analogously to the retention organ 58 protrude from the retention end 57 in the plug-in direction X. The retention element 59 and the retention guidance 60 face into the mounting direction Y. The counter retention element 62 faces into the mounting direction Y and the counter retention guidance 63 runs transversely to the mounting direction Y.

The finger protection member 25 is additionally provided with a check member 79 protruding from a retention end 57. The check member 79 has a bevel 80 and a check web 81. Further, a counter retention element 62 is formed at the retention end 57 as a lug facing into the opposite direction in the mounting direction Y than the counter retention element 62 on the finger protection member 25.

The finger protection member 25 is further provided with a stop 64 which extends perpendicularly to the plug-in direction X and forms a detent 65 in the form of a surface facing into the plug-in direction X. A guidance 66 of the finger protection member 25 runs parallel to the plug-in direction X and is formed by two guiding webs 67 which run parallel. The guidance 66 is terminated by a stabilizing arm 89 which extends from the finger protection member 25 perpendicularly to the plug-in direction. At a distal end of the stabilizing arm 88 a stabilizing element 89 in the form of a stud is provided which protrudes from the stabilizing arm 88 into the plug-in direction X.

Further, on a side of the finger protection member 25 opposing the guidance 67, a counter guidance 69 in the form of a rib is provided which runs parallel to the plug-in direction X two guidances 66 are provided which form a notch 68 running in the plug-in direction X therebetween. Each of the guidances 66 is terminated by a stabilizing arm 88.

FIG. 11 is another schematic perspective view of the finger protection member 25 shown in FIG. 10. In FIG. 11 it becomes apparent that two guidances 66 are provided which form a groove or notch 68 running parallel to the plug-in direction X therebetween. At a rear end of each of the guidances 66 a stabilizing arm 88 is provided.

FIG. 12 is a schematic perspective cross-sectional view of an embodiment of the plug-connector 1 according to the present invention along the cross-section line D-D in FIG. 1. The mounting section terminal housing 13, 13' is inserted into the outer body 2 until the latching elements 17 abut counter latching elements 82 within the outer body 2. Hence, the latching elements 17 have not yet reached an end-position E wherein they are locked in housing catches 83 formed at opposing inner side walls 84 of the outer body 2. Thus, the mounting section terminal housing 13, 13' is in a near-end position P. Further, the plug latching member 26 is located at a side of the outer body 2.

FIG. 13 is a schematic perspective cross-sectional view along the cross-section line C-C of the plug-in connector 1 in the near-end position P. The check member 79 of the finger protection member 25' is blocked by the blocking member 76 formed at the mounting section terminal housing 13, 13' in the plug-in direction X before the finger protection member 25 has reached its locked position L. The bevel 80 on the check member 79 is aligned with the check notch 77 on the blocking member 76 in the plug-in direction X. Hence, when the finger protection member 25' would be further inserted into the plug-section terminal housing 8 in the plug-in direction X, it would push the mounting section terminal housing 13' downwards in the mounting direction Y and out of the mounting opening 44, thus making it impossible to mount or assemble the plug-in connector, thereby indicating an improper state of assembly of the plug-in connector 1.

FIG. 14 is a schematic perspective view of the plug-in connector 1 in the near-end position P as shown in FIGS. 12 and 13. FIG. 14 provides an insight into the plug opening 5 wherein the finger protection member 25 is inserted into the bottom 42 of the plug face 9. The guidance 66 of the finger protection member 25 is inserted into the finger protection member guidance 38 formed at the terminal housing 8. The guiding webs 67 formed on the finger protection member 25 are fitted into the guiding grooves 41 formed at the plug-portion terminal housing 8. The stop 64 on the finger protection member does not abut against the counter stop 74 formed in the detent receptacle 74' of the plug face 42. Thus, the finger protection member 25 is in a near-locked position K. In the near-locked position, the stabilizing elements 89 on the arms 88 are aligned in the plug-in direction with stabilizing-element receptacles 90 formed in the bottom 42 of the plug face 9.

FIG. 15 is a schematic perspective view of the plug connector 1, wherein the mounting section terminal housing 13, 13', 13" is latched in an end-position E. The mounting section terminal housing 13, 13', 13" is fully inserted into the inner space 43 of the outer body. All closure members 18, 18*a*, 18*b*, 18*c* of the mounting section terminal housing 13 are sitting within their respective closure member abutments 48, 48*a*, 48*b*, 48*c*.

FIG. 16 is a schematic perspective cross-sectional view of the plug-in connector 1 in the end-position E along the cross-section line D-D in FIG. 1. In contrast to FIG. 12 which is similar to FIG. 16, the mounting section terminal housing 13, 13'; 13" is inserted into the outer body 2 until it has reached the end-position E, wherein the latching elements 17 are engaged with the housing catches 83.

FIG. 17 is a schematic perspective cross-sectional view of the plug-in connector 1 in the end-position E along the cross-section line A-A in FIG. 1. As the mounting section terminal housing 13, 13'; 13" has reached the end-position E, the locking member 76 is moved above the check member 79 in the mounting direction Y. The finger protection member 25 is in the locked position L, wherein the check member 79 has passed the blocking member 76 and the stop 64 abuts the counter stop 74 in the plug-in direction X. The counter retention element 59 has snapped behind the catch 75 formed at the plug-in portion terminal housing 8.

In FIG. 17, the plug-in connector 1 is in an assembled state S where the electrical contacts 36 are inserted into the plug-in section terminal housing 8. The plug-section terminal housing 8 is inserted into the inner space 43 of the outer body 2 in the mounting direction Y until reaching a ceiling 70 of the outer body 2 and then pushed towards the plug-in direction X until it abuts with an abutment 71 formed at the mounting section shielding element 14 against a counter abutment 72 formed at the mounting section terminal housing 13, 13', 13". The terminal housing 13, 13', 13" is inserted into the outer body 2 in the mounting direction Y until reaching the end-position E.

The finger protection member 25 is inserted with its retention end 57 into the finger protection member receptacle 73 running parallel to the plug-in direction X in form of a through hole in the bottom 42 of the plug face 9 until the stop 64 forming the detent 65 of the finger protection member 25 abuts a counter stop 74 formed at a finger protection member detent receptacle 74 in the bottom 42 of the plug face 9. The stop 64 with the detent 65 on the finger protection member 26 abuts the counter stop 74 formed in the bottom 42 of the plug face 9. Thereby, the finger protection member 25 is fully blocked within the plug-portion terminal housing 8 between the catch 75 and the counter stop 74 and thereby secured against movements in or against the plug-in direction X. The stop 64 is aligned with the bottom 42 and the retention elements 59 are latched behind a catch 75 which is formed at the plug-portion terminal housing 8 and faces in the plug-in direction X. The finger protection member 25 is in a locked position L.

Thus, movements of the finger protection member 25 against the plug-in direction X are prevented. At the sides of the retention organ 58 and counter retention organ 61 opposing the retention element 59 and the counter retention element 62, respectively, the retention guidance 60 and the counter retention guidance 63, respectively, take up forces exerted by the retention element 59 and counter retention element 62, respectively, perpendicularly to the plug-in direction X. Hence, the finger protection member 25 is stabilized against movements perpendicularly to the plug-in direction X.

The finger protection member 25 is further stabilized in that the stabilizing elements 89 sit within their designated stabilizing element receptacles 90, respectively. As the stabilizing elements 89 are located at distal ends of the arms 88, which abut the bottom 42 of the plug face 9, the finger protection member 25 is supported sidewise, i.e. laterally.

FIG. 18 is a schematic perspective cross-sectional view of a plug-in connector 301 according to the prior art. The plug-in connector 301 comprises a plug-in portion terminal housing 308 at which a finger protection member 325 is integrally formed. The finger protection member 325 juts above a front edge of the plug-portion terminal housing towards the plug-in direction X. Hence, an additional length $l_{325}$ of the finger protection member 325 adds to the length $l_8$ of a body portion of the plug portion terminal housing 308 such that a total length $l_{308}$ of the plug-portion terminal housing 308 according to the prior art exceeds the overall length $l_8$ of the pug-portion terminal housing 8 according to the present invention. All these lengths are measured in the plug-in direction X.

A length $l_{344}$ of a mounting opening 344 to the inner space 343 of the plug-in connector 301 is bigger than the length $l_{308}$ of the plug-portion terminal housing 308. Hence, the entire mounting section 304 of the plug-in connector of 301 is elongated in comparison to the mounting section 4 of a plug-in connector 1 according to the present invention.

Thus, in order to maintain an overall length of the plug-in connector 301, a length $l_{320}$ of a slid 320 between a lower edge of the plug portion 303 and an upper side of a base 306 of the outer body 302 is shorter than the length $l_{20}$ of the slid 20 at a plug-in connector 1 according to the present invention.

FIG. 19 is a schematic perspective view of a mating plug-in connector 401 according to the prior art which is not to be used for 180°-connector. A length $l_{403}$ of a mating plug portion 403 of the mating plug-in connector 401 is essentially the same as the length $l_{103}$ of the mating plug portion 103 of a mating plug-in connector 101 according to the present invention in order to assure an appropriate overlapping of the plug-portion 303 and the mating plug-portion 403. However, the length $l_{344}$ of the mounting opening 344 of the plug-in connector 304 according to the prior art limits the length $l_{320}$ of the slid 320. Hence, a recess 444 which opens into the plug-in direction X has to be formed at the mating plug portion 403 in order to make room for the extended mounting opening 344. Thus, according to the prior art, different mating plug-in connectors have to be used for 90°- and 180° connection applications. The plug-in connector and mating plug-in connector may be designed as plug and/or jack, respectively, whatever is suitable.

FIG. 20 is a schematic perspective view of an embodiment of the main electrical line 150. The main electrical line 150 comprises two electrical lines 151. Each of the electrical lines 151 is provided with mating electrical contacts 152. The mating electrical contacts 152 provide the sockets 136.

FIG. 21 is a schematic perspective view of a mating interlock member 160. The mating interlock member 160 is formed as an auxiliary electrical line which is to be mounted to the mating plug-in connector 101. The mating interlock member 160 holds and is electrically connected to the mating interlock contacts 129 providing a mating interlock receptacle 127. The embodiment of the mating interlock member shown in FIG. 21 serves as a simple short circuiting means within the mating plug-in connector 101 which is adapted to short-circuit the interlock members 32.

FIG. 22 is a schematic perspective view of the interlock members 32. The interlock contacts 29 are formed as contact pins. The interlock mounting terminals 31 are formed as sockets.

FIG. 23 is a schematic perspective view of an interlock terminal housing 500. The interlock terminal housing 500 is provided with two interlock terminal receptacles 501 which are adapted to accommodate one of the interlock mounting terminals 31 each.

FIG. 24 shows the interlock members 32 positioned so that they may be mounted to the plug-portion terminal housing 8 by inserting the interlock terminals 28 into their respective interlock contact receptacles 27 in that they are moved against the plug-in direction X. When the interlock terminals 28 are fully mated with the interlock terminal receptacles, they may be secured and locked within the interlock contact receptacles 27 with the help of an interlock locking member 600 in the form of a clamp. The interlock locking member 600 is provided with a locking element 601 in the form of a lug and two latching elements 602 in the form of latches.

An interlock locking access 91 within the plug-portion terminal housing 8 allows to insert the interlock locking member 600 into the housing 8 such that the locking element 601 reaches into a notch 92 of an interlock mounting section 93 of the plug-section terminal housing. The notch 92 reaching into the interlock contact receptacles 27 such that the locking element 601 may overlap with the interlock terminals in a projection along the plug-in direction X in order to affix the interlock terminals 28 at the plug-section terminal housing 8.

FIG. 25 is a schematic perspective view of the plug-section terminal housing 8 and the interlock members 32 mounted thereto. Here it becomes evident how the interlock contacts 29 of the interlock terminals 28 jut from the bottom 42 of the plug face 9 against the plug-in direction X. The interlock terminals 28 are locked within their respective receptacles with the help of the interlock locking member 600.

FIG. 26 shows the plug-section terminal housing 8 and the interlock members 32 shown in FIG. 25 along the cross-sectional line C-C in FIG. 1. In other words, the interlock contact receptacles 27 and the interlock terminals 28 accommodated therein are cut lengthwise parallel to the plug-in direction X. The latching elements 602 of the interlock locking member 600 encompass the interlock mounting section 93 such that the interlock locking member 600 is clamped to the plug-section terminal housing 8.

FIG. 27 is a schematic perspective view of a detail of the mounting section terminal housing 13 from below. Within the grommet 51, a passage 94 for the interlock members 32 is provided. The interlock member passage 94 serves for leading the interlock members 32 through a bottom 95 of the terminal housing 13 into a connection section of an electronic device, e.g. a high-voltage battery. The interlock mounting terminals 31 are located within the passage 94 such that the interlock members 32 may be pulled through the passage 94.

FIG. 28 is a schematic perspective view of an electrical device 700 being provided with a plug-in connector 1 according to the present invention. The electrical device 700 has a mounting plate 701 which could be part of a housing of the electrical device 700 for example. A hole 702 is formed in the mounting plate. The grommet 51 of the plug-portion terminal housing 13 is fitted into the hole 702. The electrical contacts 36 and the interlock members 32 project through the grommet 51 and below the mounting plate 701 in order to be electrically connected to the electrical device 700.

The interlock mounting terminals 31 are located within the interlock terminal receptacles 501 of the interlock terminal housing 500. The interlock terminal housing 500 facilitates to connect the interlock members 32 with the respective mating contacts (not shown) of the electronic device 700 in that the interlock terminal housing 700 enables to easily find a correct orientation of the interlock members 32 with respect to the mating contacts and to affix the interlock members 32 at the electronic device 700.

FIG. 29 shows another embodiment of interlock members 32' which may be used in connection with a plug-in connector 1 according to the present invention. The interlock members 32' are provided with interlock contacts 29' in the form of contact pins. The interlock contacts 29' may be press-fitted into their respective receptacles and are therefore provided with a retention section 29'*a* in the form of a cross-sectional widening where barbs are formed. In other words, the retention section 29'*a* is beveled towards the plug-in direction X such that it may be introduced into an interlock contact receptacle 27' within a terminal housing 8' while on the side facing against the plug-in direction X, the retention section 29'*a* has a rather sharp, i.e. perpendicular, edge which in the manner of a barbed hook prevents that the interlock contacts 29' may be easily pulled out of their respective interlock contact receptacles 27'.

Further, the interlock members 32' are provided with press-in shoulders 29'*b*, formed as rectangular cross-sectional widenings which facilitate to support a press-through at the interlock members 32' for pressing the interlock contacts 29' into their respective interlock contact receptacles 27'. The plug-in shoulders 29'*b* may additionally serve to affix the interlock contacts 29'*a* as the retention section 29' does.

Electrical lines 30' of the interlock members 32' are each formed as bare wire having a rectangular cross-section. On their ends facing away from the interlock contacts 29', the interlock electrical lines 30' are provided with press-in tips 31' in the form of sharpened ends which may be pressed into a printed circuit board (not yet shown) and/or soldered thereto.

FIG. 30 is a schematic perspective view of a plug-in portion terminal housing 8' adapted to accommodate the interlock members 32' in their respective interlock contact receptacles 27'. The interlock members 32' are arranged before the interlock contact receptacles 27' such that they may be inserted into the interlock contact receptacles 27' in the plug-in direction X.

FIG. 31 shows the plug-in section terminal housing 8' with mounted interlock members 32'. The interlock contacts 29' are inserted into the interlock contact receptacles 27' such that the tips of the interlock contacts 29' jut above the bottom 42 of the plug face 9.

FIG. 32 is a schematic perspective cross-sectional view of the plug-in section terminal housing 8' shown in FIG. 31 along the cross-sectional line C-C in FIG. 1. The interlock terminal receptacles 27' are cut along the plug-in direction X. The interlock contacts 29' are firmly held within the interlock contact receptacles 27'. A diameter of the retention section 29'*a* and the press-in shoulders 29'*b* exceeds the diameter of the interlock terminal receptacles 27'. Thereby, the retention section 29'*a* and/or the press-in shoulders 29'*b* may penetrate into a wall of the interlock contact receptacles 27' in order to be firmly held therein.

FIG. 33 shows the mounting plate 701 of the electrical device 700 which is provided with the plug-in connector 1. The grommet 51 projects through the hole 702 so that the electrical contacts 36 and the press-in tips 31' jut above the mounting plate 701. The press-in tips 31' of the interlock members 32' are pressed-fitted and/or soldered to a printed circuit board 703 which maybe electrically connected to the electrical device 700.

FIG. 34 shows the plug-in connector 1 and the mating plug-in connector 101 in a fully mated state F along the cross-sectional line C-C in FIG. 1. The plug-in connector 1 is mounted to the mounting plate 101 of the electrical device 700 such that the sealing 19 seals the base 6 of the plug-in connector 1 against the mounting plate 701 and the closure member 18 abuts the mounting plate 701. The interlock electrical lines 30' run through respective passages 94' within the bottom 95 of in a mounting section terminal housing 13". The press-in tips 31' at the end of the interlock electrical lines 30' jut below the grommet 51 sitting within the hole 702 in the mounting plate 701. The press-in tips 31' are electrically connected to the printed circuit board 703.

In the plug-portion 3, the interlock terminals 29' are plugged into the mating interlock receptacles 127 of the mating interlock contacts 129. The mating interlock member 160 carrying the mating interlock contacts 129 is held by an interlock holder 153 in the form of a beam protecting in the plug-in direction X around which the mating interlock member 160 is led. Further, the plug-portion shielding 10 encompasses the mating plug-portion shielding 110.

FIG. 35 shows another embodiment of a main electrical line 150' which may be used in connection with a plug-in connector 1 according to the present invention. The main electrical line 150' differs from the main electrical line 150 shown in FIG. 20 in that the main electrical line 150' is provided with mating interlock members 160' which may be integrated into the main electrical line 150'.

FIG. 36 shows another embodiment of an interlock member 32" which may be used in another embodiment of a plug-portion terminal housing 8". Interlock contacts 29" are formed on the interlock member 32". The interlock contacts 29" extend from a short-circuiting section 30" which serves as an interlock electrical line in that it short-circuits the interlock contacts 29". Moreover, the short-circuiting section 30" serves as a mounting section in that it is provided with retention elements 29"*a* in the form of nibs extending from the short circuiting section 30" perpendicularly to the plug-in direction X. In the back of the short-circuiting section 30", a tool-supporting section 29"*h* is provided which is adapted to support a tool for pressing the interlock member 32" into an interlock contact receptacle 27".

FIG. 37 shows the back of the plug-portion terminal housing 8". The plug-portion terminal housing 8" is provided with an interlock mounting section 93" comprising the interlock contact receptacle 27". The interlock member 32' is ready to be inserted into the interlock contact receptacle 27" by being moved parallel to the plug-in direction X.

FIG. 38 shows the plug-portion terminal housing 8" carrying the interlock member 32". The interlock contacts 29" on the interlock member 32" jut above the bottom 42 of the plug face 9. In this embodiment, no interlock lines are required which have to be led to the electrical device 700, as the interlock circuit is short-circuited in the interlock member 32" itself.

FIG. 39 shows the plug-portion terminal housing 8" equipped with the interlock member 32" in a cross-sectional view along the cross-sectional line C-C in FIG. 1. The interlock member 32" is inserted into the interlock mounting section 93" of the plug-portion terminal housing 8". The interlock contact receptacle 27" of the interlock mounting section 93" is formed such that it provides two interlock contact guiding sections 27"*a* taking up the interlock contacts 29" and an interlock retention section taking up the short-circuiting section 30". The interlock member 32" may be pressed into the interlock mounting section 93" such that the retention elements 29"*a* protrude into the wall of the interlock retention section 29"*h* in order to affix the interlock member 32" by a positive-fit and/or press-fit.

FIG. 40 shows the plug-in connector 1 in the assembled state S from below. The closure members 18, 18*a-c* of the plug mounting section terminal housing sit within their respective closure member abutments 48, 48*a-c* of the outer body 2. The contacts 36 jut below the grommet 51. The passages 94, 94' for interlock lines 30, 30' are empty as due to the short-circuiting section 30" of the interlock member 32", no electrical interlock connection has to be made with the electrical device 700.

FIG. 41 shows the plug-in connector 1 and the mating plug-in connector 101 in the fully mated state F. The interlock contacts 29" are plugged into the mating interlock receptacles 127 of the mating interlock contacts 129 which are connected to the mating interlock members 160', respectively. Short-circuiting of the mating interlock members 160' is achieved in the short-circuiting section 30" of the interlock member 32".

Deviations from the above described embodiments of a plug-in connector 1 according to the invention are possible within the inventive idea:

The outer body 2 may be provided with several plug portions 3 and/or mounting sections 4 each having a plug opening 5 and a base 6, respectively, for mating the plug-in connector with a mating plug-in connector 101 and mounting the plug-in connector 1. The plug opening 5 may be shaped, however afforded for engaging the mating plug-in connector 101 in a keyed, i.e. form-fitted or positive manner. The mounting supports 7, sealing element 19, and bushings 24 may be provided in whatever number and form desired for ensuring an adequate mountability of the plug-in connector 1. The plug portion 3 and mating plug portion 103 may be provided with plug latching members and mating plug latching members 126 interacting in whatever number and form is appropriate in order to ensure a form-fit mating, locking and/or latching of the plug-in connector 1 plugged into the mating plug-in connector 101.

The terminal housings 8, 8', 8", 13, 13', 13" may be provided as separate plug-portion terminal housing 8 and mounting section terminal housing 13, 13', 13", but may also be combined in a single terminal housing 8, 8', 8" 13, 13'. Such a single terminal housing 8, 8', 8", 13, 13', 13" could be blocked in the plug-in direction X by a blocking device (not shown) which fulfills the functionality of a rear side 85 of the terminal housing 13, 13', 13". As illustrated in FIG. 17, the rear side 85 abuts a rear wall of the outer body 2, such that movements of the plug-portion terminal housing 8 in the plug-in direction X are prevented because it abuts against a rear stop 87 formed for the plug-portion terminal housing 8 at the mounting section terminal housing 13, 13', 13". Hence, a blocking device could merely provide the rear side 85 and the rear stop 87 for locking the terminal housing 8, 8', 8", 13, 13', 13" in the plug-in direction X.

The terminal housings 8, 8', 8", 13, 13', 13" may be provided with shielding receptacles 15, mounting sockets 16, latching elements 17, interlock contact receptacles 27, 27', 27"*a*, 27"*b* electrical contact carriers 35, finger protecting member guidances 38, outer ribs 40, guiding grooves 41, plug faces 9, bottoms of plug faces 42, rear sides 85 and rear stops 87, in whatever number or form appropriate for guiding, locking and latching the terminal housings 8, 8', 8"; 13, 13', 13" within the outer body 2.

The finger protecting member guidance 38, outer ribs 40, guiding grooves 41, finger protection member receptacle 73, counter stop 74, catch 75, blocking member 76, check notch 77, and check cavity 78 provided at the terminal housings 8, 13, 13', 13" may be adapted for interacting with the protection end 56, retention end 57, retention organ 58, retention element 59, retention guidance 60, counter retention organ 61, counter retention element 62, counter retention guidance 63, stop 64, detent 65, guidance 66, guiding webs 67, notch 68, counter guidance 69, check member 79, bevel 80, check web 81, stabilizing arm 88, and stabilizing element 89 of the finger protection member 25 respectively, such that inserting, guiding and locking the finger protection member 25 in the plug-in connector 1 is ensured in a form-fit manner, i.e. keyed, coded and/or with a positive fit.

The interlock member 32, 32', 32" may be used in their different embodiments as required by any desired interlock application. It is an advantageous feature of the present invention that a single embodiment of the outer housing 2 and hence the plug-in connector 1 may take up different types of interlock members 32, 32', 32" in that only the terminal housing 8, 8', 8", 13, 13', 13" may be adapted to a certain interlock solution by modifying the interlock mounting section 93, 93', 93" in order to accommodate the desired type of interlock member 32, 32', 32". All other parts of the plug-in connector 1 and the mating plug-in connector 100 may essentially be the same for all interlock members 32, 32', 32" which helps minimizing production costs and improves versatility of the plug-in connector 1 and the mating plug-in connector 100 according to the present invention.

Shieldings 10, 11, 12, 14, 108 are not obligatory. However, when the plug-in connector 1 is used for connecting high-voltage/high-current batteries to a non-board power supply of a motor vehicle, shielding may be required. The batteries are often provided with a power converter converting direct current (DC) taken from the battery cells to alternative current (AC) which is demanded by the drive motors of electrical vehicles. The AC-power may flow in both directions either from or to the battery and its power converter, respectively. The AC-power being transmitted via lines 150 connected to the plug-in connector on and/or mating plug-in connector and the connectors themselves emit electromagnetic interference signals which may disturb other electrical and electronic systems in the surroundings of the connectors 1, 101 and the lines 150 attached thereto. These other systems may be arranged inside and outside the vehicle and have to be protected from the electromagnetic interference signals. Therefore, the connector and the lines attached thereto are provided with the shielding 10, 11, 12, 14 encompassing the power conducting elements. The electromagnetic shielding blocks and takes up the electromagnetic interference signals. Through the shielding, the energy of the interference signal is led to a ground potential connection where it may be dissipated without any interference with adjacent electrical or electronic systems. The shielding 10, 11, 12, 14 should completely surround the power lines for preventing any leakage of electromagnetic interference signals to the outside of the connector or the power lines attached thereto. The shielding 10, 11, 12, 14 may be formed as separate pieces as described herein or integrally formed.

Further, the interlock members 32 are not obligatory. The interlock members are applied for security reasons in that they may transmit signals indicating whether the plug-in connector 1 properly mated with the mating plug-in connector 101 or not.

Finally, it is not obligatory that the plug-in direction X runs perpendicularly to the mounting direction Y. However, the present invention is especially useful with angled plug-in connectors which are mounted and plugged in different directions. In any case, the present invention helps to minimize an overall length of the plug-in connector 1 in the plug-in direction X and to improve its compatibility with mating plug-in connectors.

The invention claimed is:

1. Electrical plug-in connector in particular for high-voltage connections, comprising an outer body having a plug opening for receiving a mating plug-in connector, a terminal housing for fastening an electrical contact, and a finger protection member having a protection end and a retention end, the finger protection member projecting into the plug-in direction towards the plug opening with the retention end plugged into a protection member receptacle formed in the terminal housing and running in the plug-in direction, wherein the finger protection member is a separate piece engaged with the terminal housing, the protection end extending towards the plug opening and beyond a mating end of the electrical contact.

2. Electrical plug-in connector according to claim 1, wherein the finger protection member is plugged into a protection member receptacle formed in the terminal housing and running in the plug-in direction.

3. Electrical plug-in connector according to claim 1, wherein the terminal housing is provided with a receptacle accommodating a detent and/or a stabilizing element formed at the finger protection member.

4. Electrical plug-in connector according to claim 3, wherein a side of the detent facing towards the plug-in direction is aligned with a bottom of the plug opening in a locked position of the finger protection member.

5. Electrical plug-in connector according to claim 1, wherein an assembly constituted by the terminal housing and the finger protection member plugged into the protection member receptacle has a length exceeding the length of a mounting opening of the plug-in connector which opens towards a mounting direction for inserting the terminal housing into the outer body.

6. Electrical plug-in connector according to claim 5, wherein the plug-in direction and the mounting direction are perpendicular to each other.

7. Electrical plug-in connector according to claim 1, wherein a blocking member is provided at the terminal housing which in a near-end-position where the terminal housing is not fully latched with the outer body constitutes a stopping element blocking the plugging of the finger protection member.

8. Electrical plug-in connector according to claim 7, wherein in an end position a cavity formed at the blocking member is aligned with the protection member receptacle in a projection towards the plug-in direction.

9. Electrical plug-in connector according to claim 7, wherein the blocking member is provided with a check notch having a bottom ascending along the plug-in direction towards an upper end of the blocking member.

10. Electrical plug-in connector according to claim 1, wherein a length of a slit formed between a plug portion of the outer body and a base of the plug-in connector is essentially the same as a length of a portion of the engaged finger protection member extending in the plug-opening.

11. Finger protection member for an electrical high-voltage plug-in connector, with a bar-shaped body having a protection end, wherein an end portion of the finger protection member opposing the protection end is formed as a retention end having at least one retention element for affixing the finger protection member in the plug-in connector, and a stabilizing arm extending from the protection end perpendicularly to the plug-in direction, and a stabilizing element protruding from the stabilizing arm in the plug-in direction.

12. Finger protection member according to claim 11, wherein the finger protection member is provided with at least one stabilizing arm protruding from the finger protection member essentially perpendicularly to the plug-in direction, the stabilizing arm adapted to laterally support the finger protection member.

13. Finger protection member according to claim 11, wherein a check member is formed at the retention end and protrudes therefrom in the plug-in direction in order to interfere with a space occupied by a blocking member within the plug-in connector, when the plug-in connector is in an near-end-position.

14. Construction kit for a high-voltage electrical plug-in connector, comprising an outer body with a plug opening for receiving a mating plug-in connector, and at least one terminal housing for fastening an electrical contact, wherein the construction kit further comprises a finger protection member according to claim 6.

15. Method for assembling a plug-in connector, in particular for high-voltage connections, wherein a terminal housing of the plug-in connector is inserted into an outer body of the plug-in connector having a plug opening which opens towards a plug-in direction of the plug-in connector, wherein a finger protection member is plugged into the terminal housing through the plug opening, leaving a protection end extending towards the plug opening and beyond a mating end of the electrical contact.

* * * * *